US010289031B2

(12) United States Patent
Minamoto et al.

(10) Patent No.: US 10,289,031 B2
(45) Date of Patent: May 14, 2019

(54) DEVELOPER CONTAINER AND IMAGE FORMING APPARATUS INCLUDING THE SAME

(71) Applicant: KYOCERA Document Solutions Inc., Osaka-shi (JP)

(72) Inventors: Riku Minamoto, Osaka (JP); Sadanori Nakae, Osaka (JP); Takahisa Nakaue, Osaka (JP); Koichi Hayashi, Osaka (JP); Daisuke Eto, Osaka (JP); Daichi Kawano, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/106,193

(22) Filed: Aug. 21, 2018

(65) Prior Publication Data

US 2019/0064703 A1 Feb. 28, 2019

(30) Foreign Application Priority Data

Aug. 25, 2017 (JP) ..... 2017162794

(51) Int. Cl.
*G03G 15/08* (2006.01)
*G03G 15/095* (2006.01)

(52) U.S. Cl.
CPC ..... *G03G 15/095* (2013.01); *G03G 15/0848* (2013.01); *G03G 15/0865* (2013.01); *G03G 15/0889* (2013.01)

(58) Field of Classification Search
CPC ..... G03G 15/0845; G03G 15/0865; G03G 15/0867; G03G 15/087; G03G 15/0889; G03G 21/1676; G03G 2215/066; G03G 2215/0663; G03G 2215/0668; G03G 2215/085; G03G 2221/163; G03G 15/0848; G03G 15/095
See application file for complete search history.

(56) References Cited

U.S. PATENT DOCUMENTS 9,134,651 B1 * 9/2015 Eto ..... G03G 15/0889
2008/0199222 A1 * 8/2008 Nakajima ..... G03G 15/0822 399/254

(Continued)

FOREIGN PATENT DOCUMENTS

JP 2015-125333 7/2015

*Primary Examiner* — Sophia S Chen
(74) *Attorney, Agent, or Firm* — Gerald E. Hespos; Michael J. Porco; Matthew T. Hespos

(57) ABSTRACT

A developer container includes a container main body having an internal space and a developer discharge port; a movable wall moving in the internal space toward the developer discharge port; a detection surface which is a part of an inner peripheral surface that divides a storage space of a developer in the container main body and which becomes a detection region of a first detection sensor which detects the developer in the storage space; and a rotating body arranged in the storage space and capable of rotating around a rotary shaft along the first direction. The rotating body is mounted with a cleaning member which cleans the detection surface, a stirring member which stirs a developer in the storage space, and a detection target member to be a detection target of a second detection sensor which detects presence of the container main body.

12 Claims, 21 Drawing Sheets

(56) References Cited

U.S. PATENT DOCUMENTS

| | | | | |
|---|---|---|---|---|
| 2008/0286005 | A1* | 11/2008 | Ushikubo ..... | G03G 15/0865<br>399/119 |
| 2015/0185661 | A1 | 7/2015 | Eto | |
| 2016/0216641 | A1* | 7/2016 | Makie ..... | G03G 15/0894 |
| 2016/0223945 | A1* | 8/2016 | Hayashi ..... | G03G 15/0865 |

* cited by examiner

DEVELOPER CONTAINER AND IMAGE FORMING APPARATUS INCLUDING THE SAME

INCORPORATION BY REFERENCE

This application is based on Japanese Patent Application No. 2017-162794 filed on Aug. 25, 2017 to the Japan Patent Office, the contents of which are incorporated by reference.

BACKGROUND

The present disclosure relates to a developer container including a movable wall which conveys a developer toward a developer discharge port, and an image forming apparatus including the same.

An image forming apparatus forming a toner image on a sheet includes a photosensitive drum, a developing device, and a developer container. The developer container replenishes a developer to the developing device. There is known as prior art a developer container having a movable wall that conveys a developer toward a developer discharge port. Movement of the movable wall is controlled so as to draw near to the developer discharge port according to consumption of a developer stored in a container main body of the developer container. Consumption of the developer is monitored by a detection sensor of a developer installed outside of the container main body, and movement of the movable wall is controlled on the basis of a sensing result of the detection sensor.

SUMMARY

A developer container according to one aspect of the present disclosure includes a container main body, a movable wall, a detection surface, and a rotating body. The container main body includes an inner peripheral surface which defines an internal space tubularly extending in a first direction, and a developer discharge port which is opened to communicate with the internal space and through which a developer is discharged. The movable wall includes an outer peripheral surface arranged to be opposed to the inner peripheral surface of the container main body, and a conveying surface which defines, together with the inner peripheral surface of the container main body, a storage space in which the developer is stored, the movable wall moving in the internal space in the first direction while conveying the developer in the storage space toward the developer discharge port. The detection surface is a part of the inner peripheral surface in the storage space of the container main body and becomes a detection region of a first detection sensor which detects the developer in the storage space. The rotating body is arranged in the storage space and is capable of rotating around a rotary shaft along the first direction.

The rotating body is mounted with a cleaning member which cleans the detection surface, a stirring member which stirs a developer in the storage space, and a detection target member to be a detection target of a second detection sensor which detects presence of the container main body.

An image forming apparatus according to another aspect of the present disclosure includes an image carrier having a peripheral surface on which an electrostatic latent image is formed, a developing device which supplies a developer to the peripheral surface of the image carrier for developing the electrostatic latent image, the above developer container which replenishes the developer to the developing device, a first detection sensor which detects a developer in the developer container, and a second detection sensor which detects presence of the container main body.

DETAILED DESCRIPTION

<Overall Configuration of Image Forming Apparatus>

Figure 1:
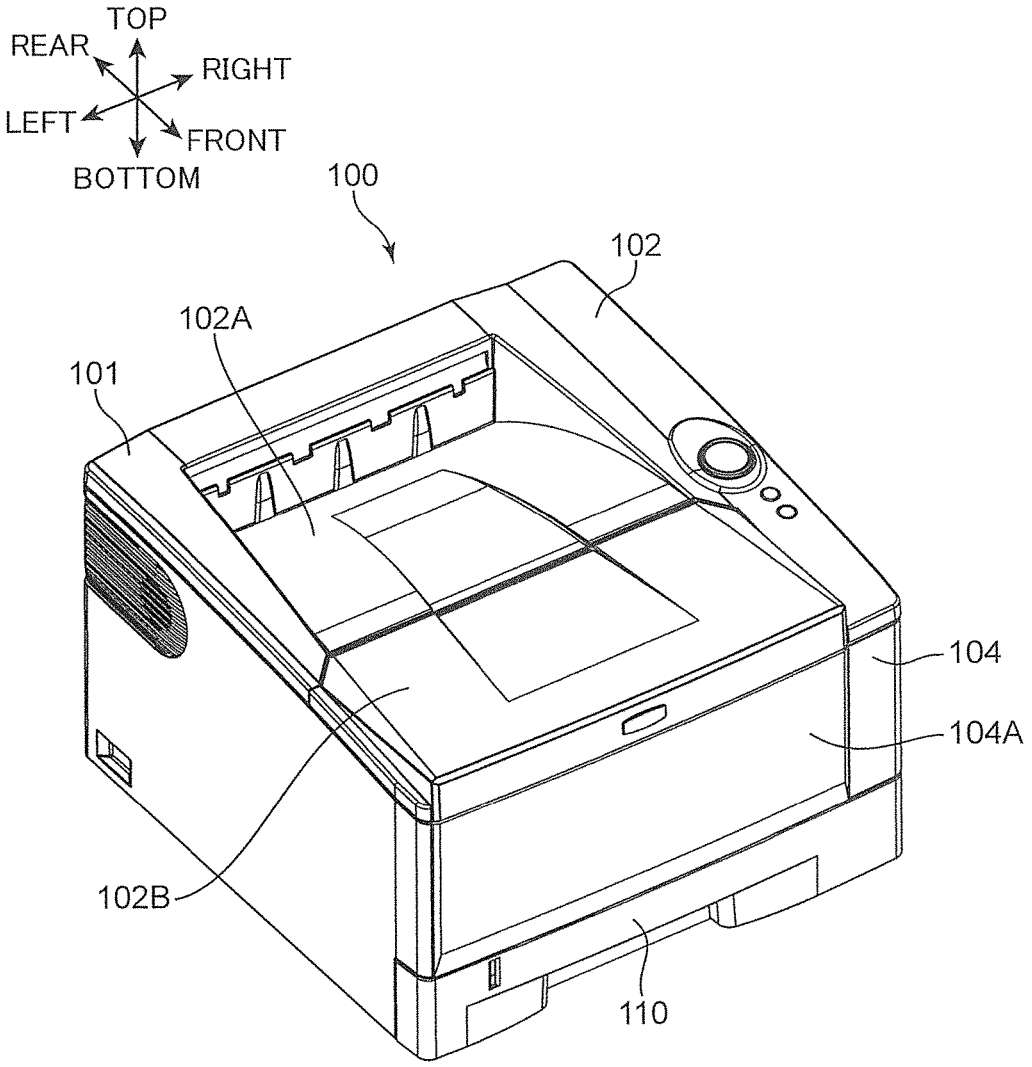
FIG. 1 is a perspective view showing an appearance of an image forming apparatus according to one embodiment of the present disclosure.
Figure 2:
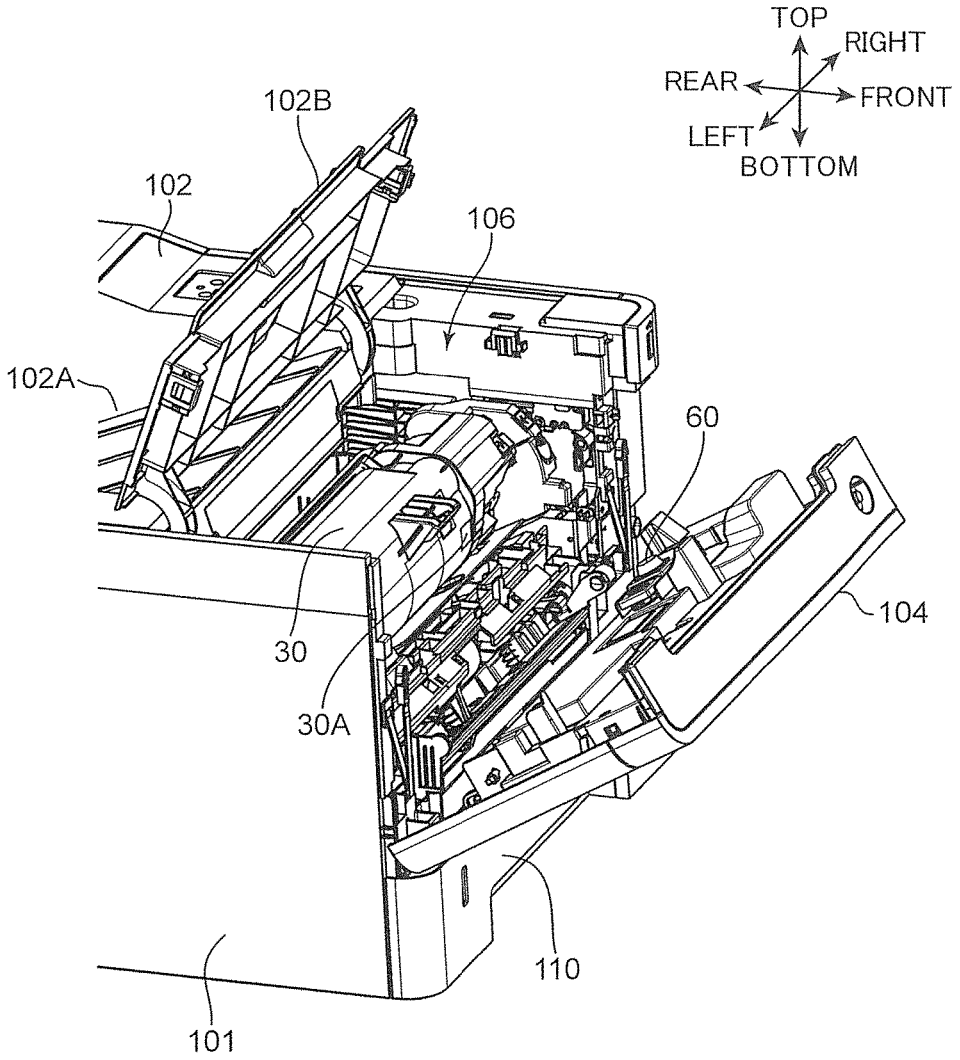
FIG. 2 is a perspective view showing a state in which a part of a housing of the image forming apparatus is opened.
Figure 3:
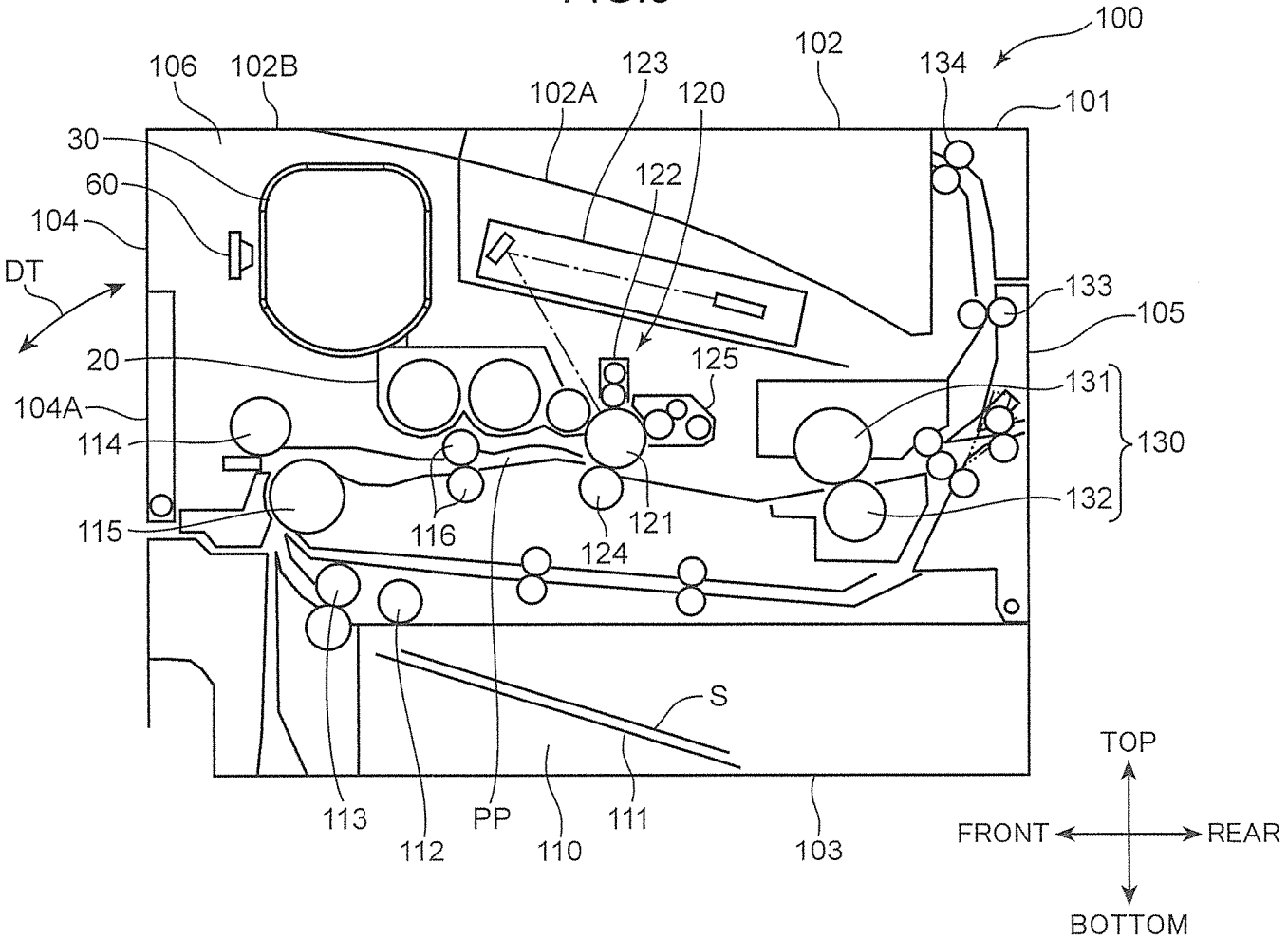
FIG. 3 is a sectional view schematically showing an internal structure of the image forming apparatus.

In the following, an image forming apparatus according to one embodiment of the present disclosure will be described with reference to the drawings. FIG. 1 is a perspective view showing an appearance of a printer 100 (image forming apparatus) according to one embodiment of the present disclosure, FIG. 2 is a perspective view showing a state in which a part of a housing 101 of the printer 100 is opened, and FIG. 3 is a sectional view schematically showing an internal structure of the printer 100. Although the printer 100 shown as one example of an image forming apparatus herein is a so-called monochrome printer, the image forming apparatus in other embodiment may be a color printer, a facsimile machine, a multifunction machine having these functions, or other device for forming a toner image on a sheet. It should be noted that the terms "top", "bottom", "front", "rear", "left" and "right" indicating directions which are used in the following description are merely intended to clarify the explanation, and are not at all intended to limit the principle of the image forming apparatus.

The printer 100 includes the housing 101 which houses various devices for forming an image on a sheet S. The housing 101 includes a top wall 102 which defines a top surface of the housing 101, a bottom wall 103 which defines a bottom surface of the housing 101, a main body rear wall 105 vertically arranged between the top wall 102 and the bottom wall 103, and a front cover 104 positioned ahead of the main body rear wall 105. The housing 101 includes a main body internal space 106 in which various devices are arranged. A sheet conveyance passage PP, in which the sheet S is conveyed in a predetermined conveying direction, is provided to extend in the main body internal space 106.

A sheet discharge portion 102A is arranged in a central portion of the top wall 102. The sheet discharge portion 102A is formed of an inclination surface which downwardly inclines from a front part toward a rear part of the top wall 102. The sheet S is discharged to the sheet discharge portion 102A, on which an image is formed in an image forming unit 120 to be described later. A manual feed tray 104A is arranged on the front cover 104. A front side of the sheet discharge portion 102A is configured with an upper cover 102B which can be opened upward. The manual feed tray 104A is movable up and down with a lower end thereof acting as a fulcrum (an arrow DT in FIG. 3). When the upper cover 102B of the top wall 102 is opened in addition to the manual feed tray 104A, a toner container 30 attached in the main body internal space 106 is exposed to enable detachment of the toner container 30 as shown in FIG. 2.

With reference to FIG. 3, an internal structure of the printer 100 will be described. The printer 100 includes a sheet feeding cassette 110, a pick-up roller 112, a first sheet feeding roller 113, a second sheet feeding roller 114, a conveying roller 115, a resist roller pair 116, the image forming unit 120, and a fixing device 130.

The sheet feeding cassette 110 can be drawn forward of the housing 101 and houses the sheet S therein. The cassette 110 includes a lift plate 111 which pushes up a leading edge of the sheet S. The pick-up roller 112 is arranged over the leading edge of the sheet S pushed up by the lift plate 111. When the pick-up roller 112 rotates, the sheet S is drawn out from the sheet feeding cassette 110. The first sheet feeding roller 113 is disposed downstream of the pick-up roller 112 to send out the sheet S further downstream. The second sheet feeding roller 114 is disposed at an inner side of the fulcrum of the manual feed tray 104A (back side) to draw the sheet S on the manual feed tray 104A into the housing 101.

The conveying roller 115 is disposed on a downstream side of a sheet conveying direction of the first sheet feeding roller 113 and the second sheet feeding roller 114 to convey the sheet S further downstream. The resist roller pair 116 has a function of correcting oblique conveyance of the sheet S. This adjusts a position of an image formed on the sheet S. The resist roller pair 116 supplies the sheet S to the image forming unit 120 at timing of image formation by the image forming unit 120.

The image forming unit 120 includes a photosensitive drum 121 (image carrier), a charger 122, an exposure device 123, a developing device 20, the toner container 30 (developer container), a transfer roller 124, and a cleaning device 125.

The photosensitive drum 121 has a peripheral surface which carries an electrostatic latent image and a toner image corresponding to the electrostatic latent image (developer image). A predetermined charging bias is applied to the charger 122 to charge the peripheral surface of the photosensitive drum 121 substantially uniformly. The exposure device 123 scans the peripheral surface of the photosensitive drum 121 charged by the charger 122 with laser light modified by image data. This scan forms an electrostatic latent image corresponding to the image data on the peripheral surface of the photosensitive drum 121. The exposure device 123 is supported by a support frame arranged inside the housing 101.

The developing device 20 supplies a toner to the peripheral surface of the photosensitive drum 121 on which an electrostatic latent image is formed. The toner container 30 replenishes a toner to the developing device 20. The toner container 30 is detachably disposed on the developing device 20. When the developing device 20 supplies the toner to the photosensitive drum 121, the electrostatic latent image formed on the peripheral surface of the photosensitive drum 121 is developed (visualized). As a result, a toner image is formed on the peripheral surface of the photosensitive drum 121.

The transfer roller 124 forms a transfer nip portion with the photosensitive drum 121, and transfers a toner image carried on the peripheral surface of the drum to the sheet S. After the toner image is transferred to the sheet S, the cleaning device 125 removes the toner remaining on the peripheral surface of the photosensitive drum 121.

The fixing device 130 is arranged on the downstream side of the image forming unit 120 in the conveying direction and fixes a toner image on the sheet S. The fixing device 130 includes a heating roller 131 for melting the toner on a sheet S and a pressure roller 132 for bringing the sheet S into close contact with the heating roller 131.

The printer 100 further includes a conveying roller pair 133 disposed downstream of the fixing device 130 and a discharge roller pair 134 disposed downstream of the conveying roller pair 133. The sheet S is conveyed upward by the conveying roller pair 133 and finally discharged from the housing 101 by the discharge roller pair 134. The sheets S discharged from the housing 101 are stacked on the sheet discharge portion 102A.

<About Developing Device>

Figure 4:
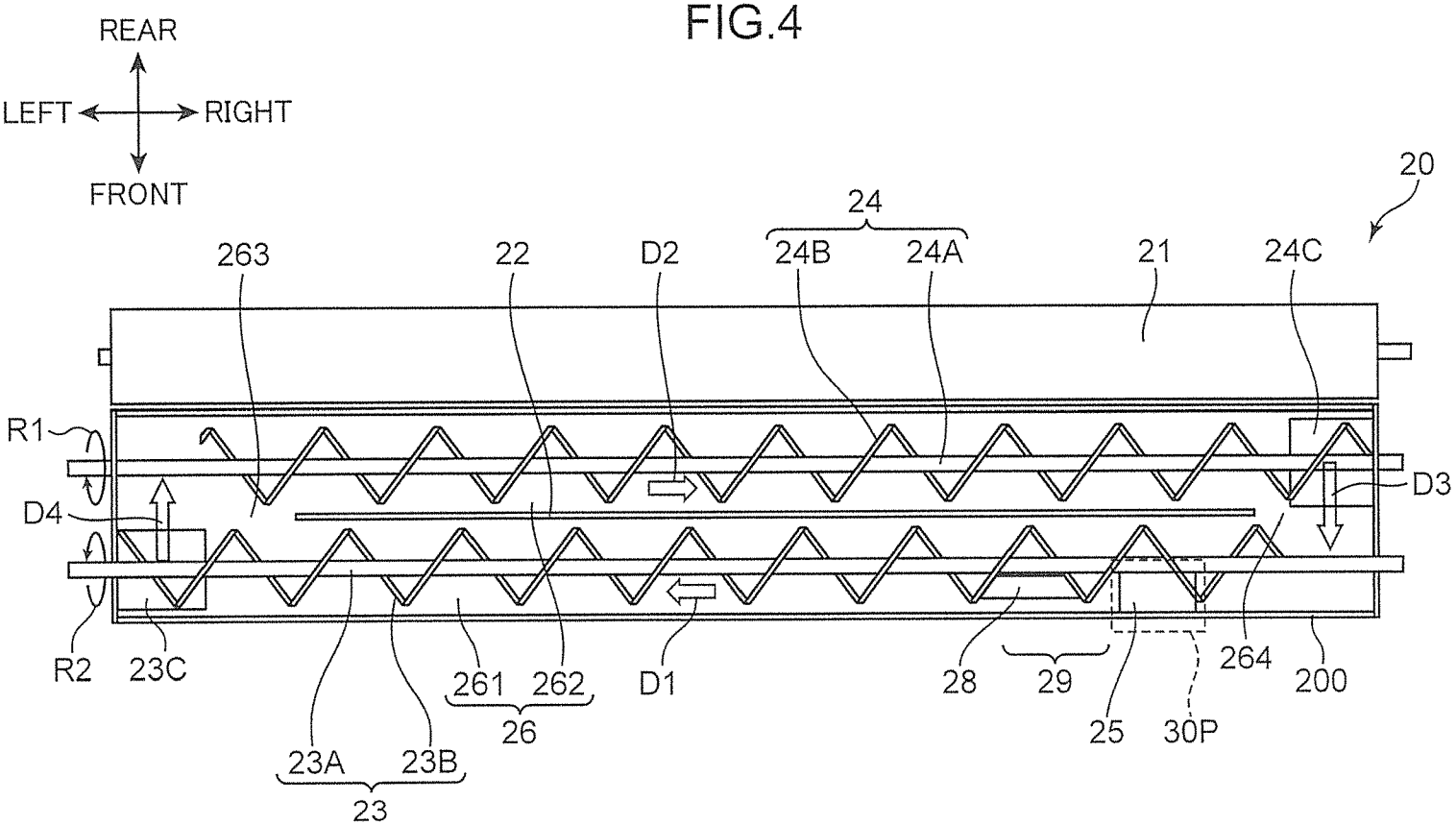
FIG. 4 is a plan view schematically showing an internal structure of a developing device attached to the image forming apparatus.

FIG. 4 is a plan view showing an internal structure of the developing device 20. The developing device 20 includes a developing roller 21, a development housing 200, a first stirring screw 23 and a second stirring screw 24 housed in the development housing 200, and a toner supply port 25 opened in the development housing 200.

The developing roller 21 has a cylindrical shape and has a roller shaft extending in a right and left direction, and a sleeve portion arranged on an outer periphery and driven to rotate. The development housing 200 has a box-shape long in an axial direction of the developing roller 21, and includes a developer conveyance passage 26 and a partition plate 22 in an internal space thereof. The developer conveyance passage 26 is a passage which is filled with a developer and on which the developer is circularly conveyed. In the present embodiment, a one-component developing method is applied, and the developer conveyance passage 26 is filled with a toner as a developer. In another embodiment to which a two-component developing method is applied, the developer conveyance passage 26 is filled with a mixture of a toner and a magnetic carrier as a developer. The toner is stirred and conveyed in the developer conveyance passage 26, and is sequentially supplied from the developing roller 21 to the peripheral surface of the photosensitive drum 121 on which an electrostatic latent image is formed in order to develop the electrostatic latent image.

The developer conveyance passage 26 includes a first conveyance passage 261 and a second conveyance passage 262. In the first conveyance passage 261, a developer is conveyed in a direction of an arrow D1 along the axial direction of the developing roller 21. The second conveyance passage 262 is arranged between the developing roller 21 and the first conveyance passage 261. In the second conveyance passage 262, a developer is conveyed in a direction of an arrow D2 opposite to a first conveying direction. The upper portion of the developer conveyance passage 26 is covered with a housing top plate (not shown).

The partition plate 22 is arranged in the development housing 200 so as to extend in the right and left direction. The partition plate 22 partitions the first conveyance passage 261 and the second conveyance passage 262 along the axial direction of the developing roller 21 such that the first conveyance passage 261 and the second conveyance passage 262 communicate with each other in right and left end portions. Therefore, the partition plate 22 is set to be shorter than a width of the development housing 200 in the right and left direction. This makes the developer conveyance passage 26 a circulation passage from the first conveyance passage 261 through a first communication passage 263 and the second conveyance passage 262 to reach a second communication passage 264 as shown by arrows D1, D2, D3, and D4.

The toner supply port 25 is an opening portion opened in the top plate of the development housing 200. The toner supply port 25 is an opening which is arranged above the vicinity of a right end of the first conveyance passage 261 so as to be opposed to the above-described circulation passage, and which receives (makes inflow of) a replenishment toner (replenishment developer) replenished from the toner container 30 into the developer conveyance passage 26.

The first stirring screw 23 is disposed in the first conveyance passage 261 and includes a first screw shaft 23A, and a spiral blade 23B protruding in a spiral shape on a circumference of the first screw shaft 23A. The first screw shaft 23A extends in the right and left direction in parallel with the developing roller 21. The first stirring screw 23 is rotated with the first screw shaft 23A as a rotary shaft (an arrow R2) to convey a toner in the direction of the arrow D1 in FIG. 4. The first stirring screw 23 conveys a developer in the first conveyance passage 261 so as to pass below the toner supply port 25. In this manner, the first stirring screw 23 conveys a new toner flowing into the toner supply port 25 and a toner conveyed from the second conveyance passage 262 side into the first conveyance passage 261 while mixing the toners with each other.

A paddle 23C is disposed on a downstream side of the first stirring screw 23 in a toner conveying direction (a D1 direction). The paddle 23C is a plate-shaped member disposed on the first screw shaft 23A. The paddle 23C is rotated together with the first screw shaft 23A to deliver a toner from the first conveyance passage 261 to the second conveyance passage 262 through the first communication passage 263 toward a direction of the arrow D4 in FIG. 2.

The second stirring screw 24 includes a second screw shaft 24A disposed in the second conveyance passage 262 and extending in the right and left direction, and a spiral blade 24B protruding in a spiral shape on a circumference of the second screw shaft 24A. The second stirring screw 24 is rotated with the second screw shaft 24A as a rotary shaft (an arrow R1) to supply a toner to the developing roller 21 while conveying the toner in a direction of the arrow D2 in FIG. 4. A paddle 24C is disposed on a downstream side of the second stirring screw 24 in a toner conveying direction (a D2 direction). The paddle 24C is rotated together with the second screw shaft 24A to deliver a toner from the second conveyance passage 262 to the first conveyance passage 261 through the second communication passage 264 toward a direction of the arrow D3 in FIG. 2.

Figure 12:
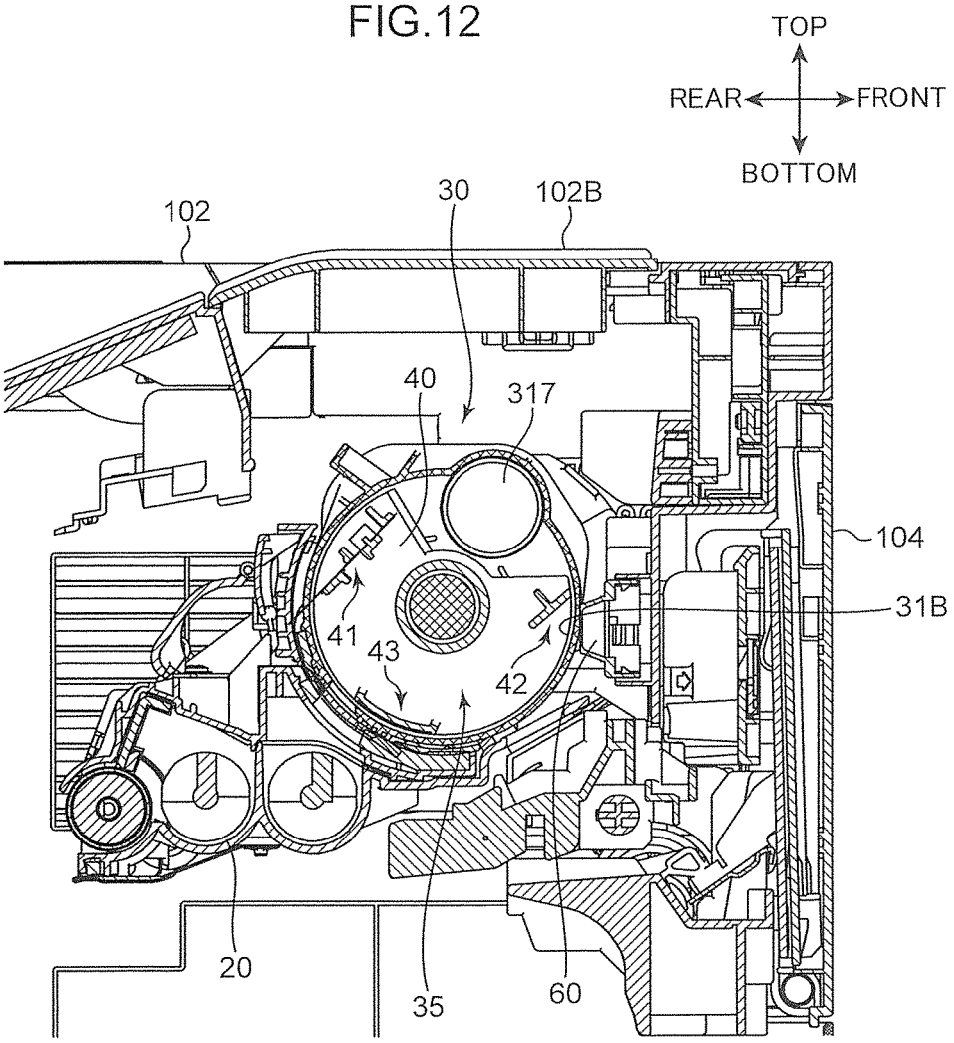
FIG. 12 is a sectional view of a part, in the image forming apparatus, where the toner container and a toner sensor are mounted.

The toner container 30 is arranged above the toner supply port 25 of the development housing 200 (see FIG. 2, FIG. 3, and FIG. 12). The toner container 30 includes a toner discharge port 30P (FIG. 4). The toner discharge port 30P is disposed in a bottom portion of the toner container 30 so as to be opposed to the toner supply port 25 of the developing device 20. A toner falling down from the toner discharge port 30P is replenished from the toner supply port 25 to the developing device 20.

The printer 100 of the present embodiment includes a toner sensor 60 for detecting a toner housed in the toner container 30, i.e., for detecting whether a predetermined amount of toner is present in a later-described storage space 31S of the toner container 30 as shown in FIG. 2 and FIG. 3. The toner sensor 60 of the present embodiment is a magnetic permeability sensor which detects a magnetic permeability of a detection target. The toner sensor 60 is attached to an inner wall side of the front cover 104, and when the front cover 104 is closed to the housing 101, comes into contact with a sensor contact surface 30A set in an outer periphery of the toner container 30.

<About Toner Replenishment>

Figure 5:
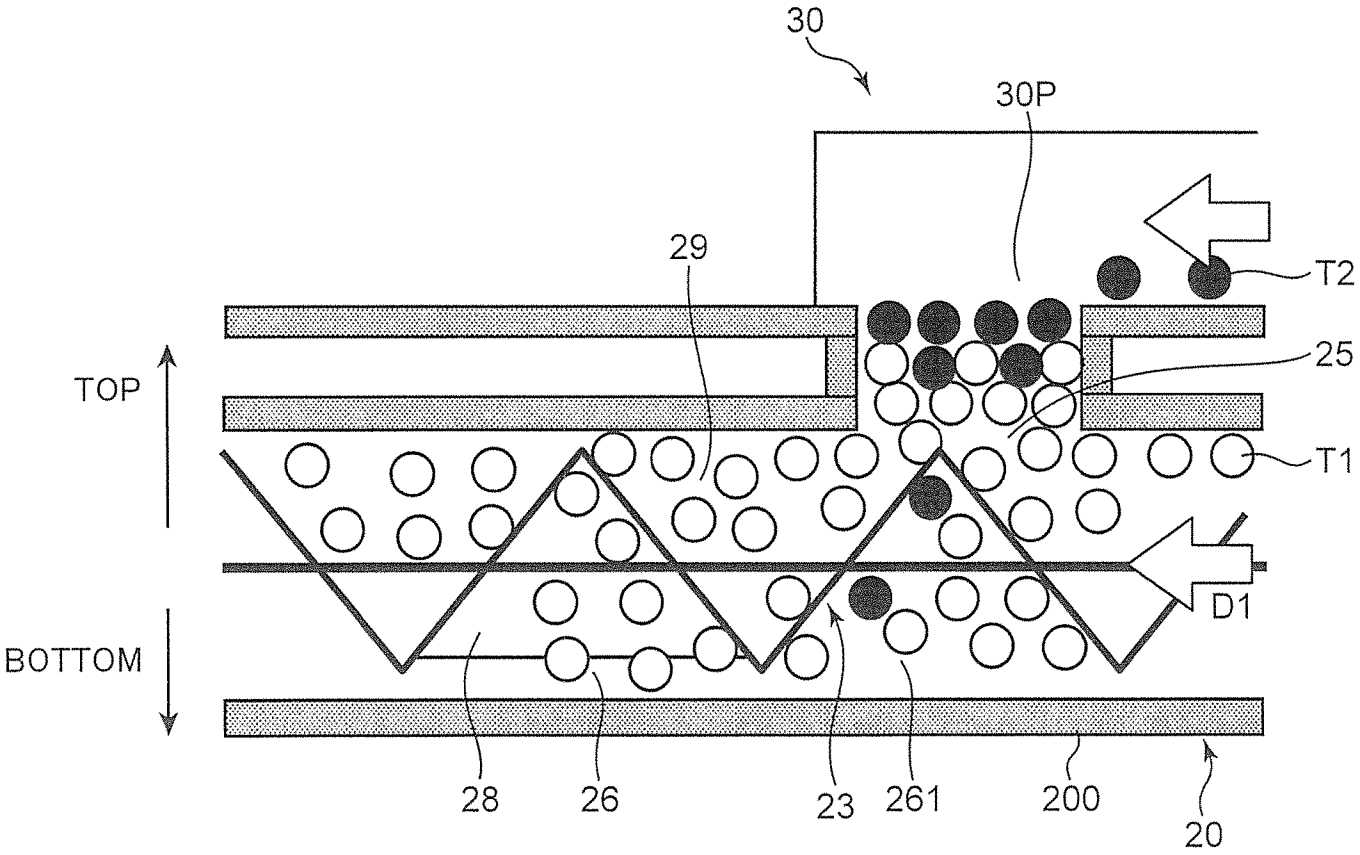
FIG. 5 is a schematic sectional view showing how a developer is replenished to the developing device by a volume replenishment method.

Next, a flow of a toner newly replenished from the toner supply port 25 will be described in detail. FIG. 5 is a schematic sectional view showing the vicinity of the toner supply port 25 disposed in the developing device 20 and the toner discharge port 30P disposed in the toner container 30. A replenishment toner T2 supplied from the toner discharge port 30P to the toner supply port 25 falls down to the first conveyance passage 261 and is mixed with an existing toner T1 and conveyed by the first stirring screw 23 in the direction of the arrow D1. At this time, the toners T1 and T2 are stirred and charged.

The first stirring screw 23 includes a conveying ability reducing portion 28 provided on a downstream side of the toner supply port 25 in the toner conveying direction for partially suppressing a toner conveying ability of the first stirring screw 23. In the present embodiment, the conveying ability reducing portion 28 is illustrated as a plate-shaped paddle arranged between the adjacent spiral blades 23B of the first stirring screw 23. Rotation of the conveying ability reducing portion 28 around the first screw shaft 23A causes a toner, which is conveyed from an upstream side of the conveying ability reducing portion 28, to start accumulation. Then, the toner will be accumulated up to a position which is immediately upstream of the conveying ability reducing portion 28 and at which the toner supply port 25 is opposed to the first conveyance passage 261. As a result, an accumulation portion 29 of a toner is formed in the region to which the toner supply port 25 is opposed.

When the replenishment toner T2 is replenished from the toner supply port 25 to increase a toner amount in the developer conveyance passage 26, the toner accumulated in the accumulation portion 29 blocks the toner supply port 25 from below to suppress further replenishment of toner. Thereafter, when the toner in the developer conveyance passage 26 is consumed from the developing roller 21 to reduce an amount of toner accumulated in the accumulation portion 29, the amount of the toner blocking the toner supply port 25 is reduced to generate a gap between the accumulation portion 29 and the toner supply port 25. As a result, the replenishment toner T2 again flows from the toner supply port 25 into the developer conveyance passage 26 (the first conveyance passage 261). Thus, the present embodiment employs a volume-replenishment type toner supply method in which an amount of the replenishment toner to be accepted is adjusted as the toner accumulated in the accumulation portion 29 is reduced.

<Configuration Related to Attachment of Toner Container to Developing Device>

Figure 6:
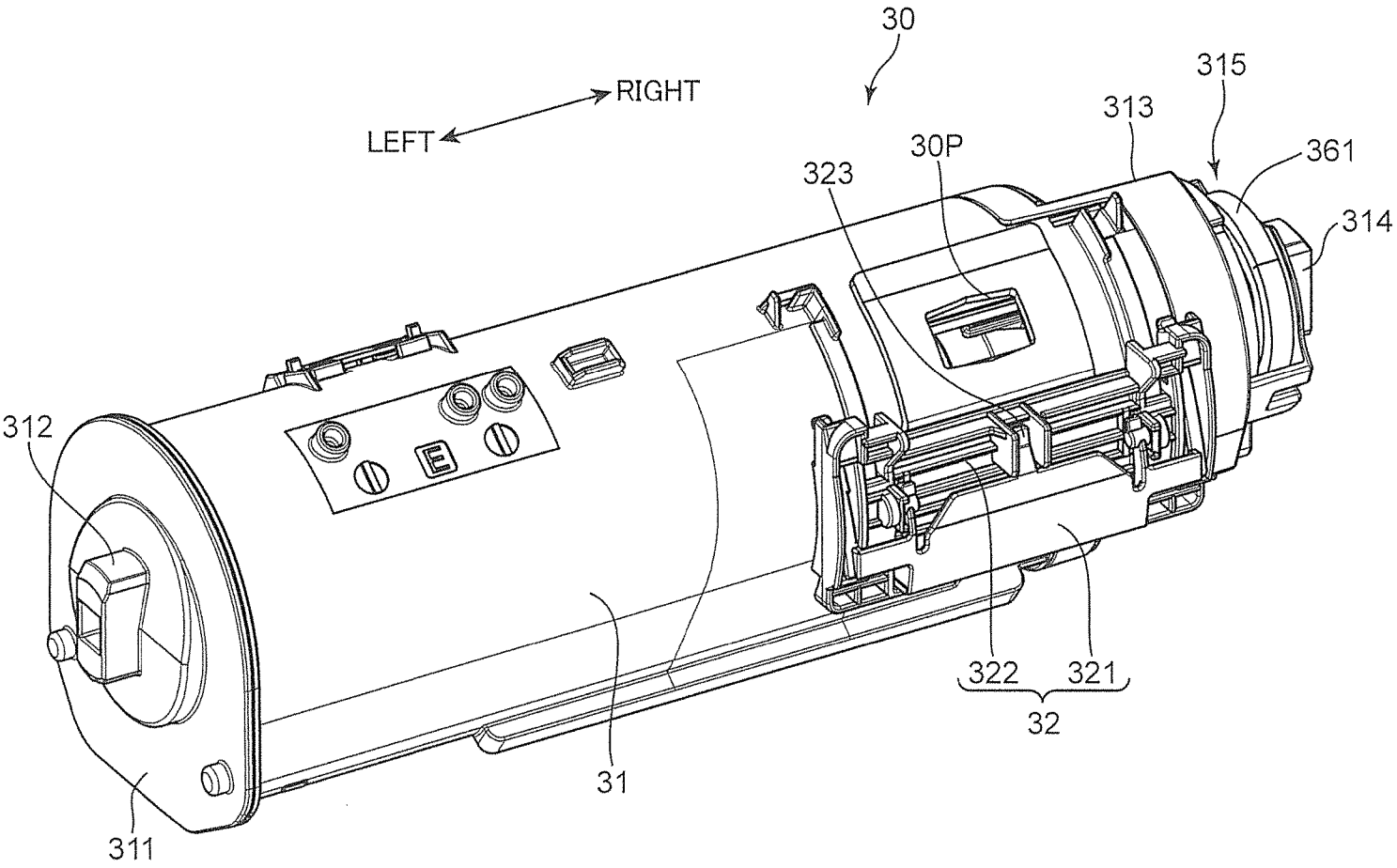
FIG. 6 is a perspective view of a toner container (developer container) according to the one embodiment of the present disclosure.
Figure 7:
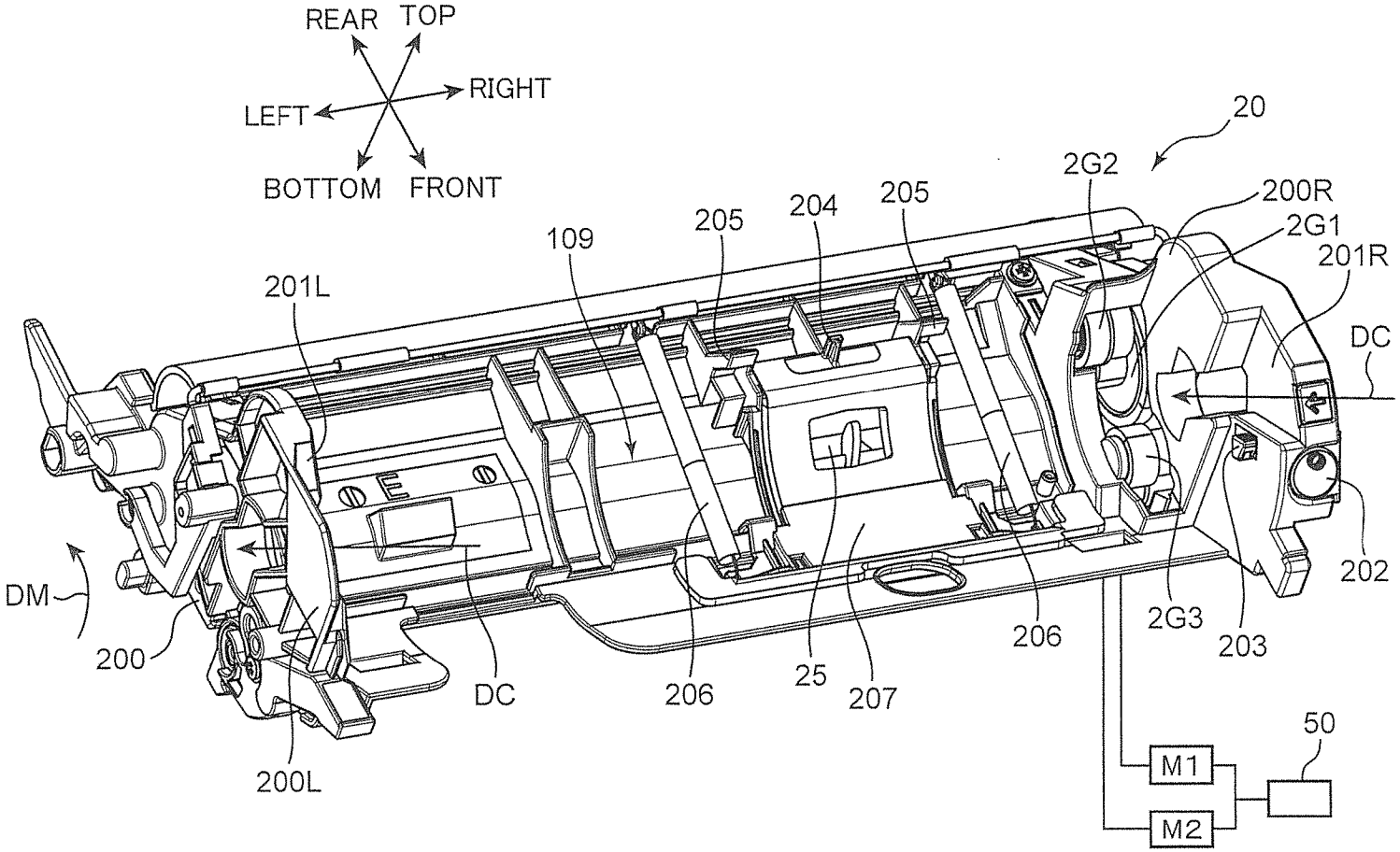
FIG. 7 is a perspective view of the developing device.

FIG. 6 and FIG. 7 are perspective views of the toner container 30 and the developing device 20 according to the present embodiment, respectively. Description will be herein made of appearance structures of the toner container 30 and the developing device 20, and a configuration related to attachment of the toner container 30 to the developing device 20.

The toner container 30 is detachable from the developing device 20 in the housing 101 and includes a container main body 31 (container main body) and a container shutter 32. The container main body 31 is a tubular part forming a main body of the toner container 30, and stores a toner therein (an internal structure thereof will be described later in detail). The container shutter 32 is mounted on a periphery of the container main body 31 in the vicinity of a right end thereof.

A left end side of the container main body 31 is an opening end, and a lid 311 for closing the opening end is mounted on the left end side. On the right end side of the container main body 31, a drive input unit including a first gear member 36 and a second gear member 37 to be described later is arranged, and a cover portion 313 for covering the members is mounted on the right end side. In order to guide the toner container 30 to the developing device 20 so as to be attached, a left guide portion 312 is provided to protrude on a left side surface of the lid 311, and a right guide portion 314 is provided to protrude on a right side surface of the cover portion 313.

The container shutter 32 is slidably supported relative to the container main body 31 in a circumferential direction and has a function of blocking and opening the toner discharge port 30P of the container main body 31. The container shutter 32 has a shutter main body 321, a lock portion 322, and a lock release portion 323. The shutter main body 321 is a plate having a function of blocking and opening the toner discharge port 30P. The lock portion 322 is swingably supported with respect to the shutter main body 321 and has a function of allowing and restricting slide movement of the shutter main body 321 relative to the container main body 31. The lock release portion 323 is a projecting piece provided in the lock portion 322. When the lock release portion 323 is pressed, a lock piece (not shown) and provided in the lock portion 322 is detached from an engagement portion formed in the container main body 31 to allow slide movement of the shutter main body 321.

With reference to FIG. 7, the development housing 200 includes a housing left wall 200L and a housing right wall 200R vertically arranged in right and left end portions thereof. A space between the housing left and right walls 200L and 200R is a container attachment portion 109 to which the toner container 30 is attached. A left guide groove 201L is provided on an inner surface of the housing left wall 200L and a right guide groove 201R is provided on an inner surface of the housing right wall 200R. At the time of attachment of the toner container 30 to the container attachment portion 109, the left guide portion 312 of the toner container 30 is guided by the left guide groove 201L and the right guide portion 314 is guided by the right guide groove 201R. In the present embodiment, the toner container 30 is attached to the container attachment portion 109 from diagonally above (see an arrow DC in FIG. 7).

The developing device 20 includes a first transmission gear 2G1, a second transmission gear 2G2, and a third transmission gear 2G3. The printer 100 includes a first motor M1 and a second motor M2 provided in the housing 101, and a controller 50. The first to third transmission gears 2G1 to 2G3 are gears rotatably supported on the housing right wall 200R. The first transmission gear 2G1 is coupled to the second transmission gear 2G2 and also is coupled to the developing roller 21 and the first and second stirring screws 23 and 24 via a gear group (not shown). When the developing device 20 is attached to the housing 101, the first motor M1 is coupled to the third transmission gear 2G3, and the second motor M2 is coupled to the first transmission gear 2G1.

The first motor M1 causes a later-described shaft portion 33 of the toner container 30 to rotate via the third transmission gear 2G3, thereby moving a later-described movable wall 34 of the toner container 30. Specifically, the third transmission gear 2G3 meshes with the later-described first gear member 36 of the toner container 30 to transmit a driving force of the first motor M1 to the first gear member 36. The second motor M2 causes the developing roller 21, the first and second stirring screws 23 and 24 of the developing device 20 to rotate via the first transmission gear 2G1. Further, the second motor M2 causes a later-described rotating body 35 of the toner container 30 to rotate via the first transmission gear 2G1 and the second transmission gear 2G2. The controller 50 controls the first and second motors M1 and M2 in printing operation of the printer 100 to drive the respective members of the developing device 20 and the toner container 30.

The development housing 200 includes a lock release button 202, the above-described toner supply port 25, a releasing projection portion 204, a pair of container shutter fixing portions 205, a pair of shutter springs 206, and a housing shutter 207.

The lock release button 202 is a press button slidably supported in the housing right wall 200R, and includes a lock engagement piece 203. The lock release button 202 has a function of locking a position of the toner container 30 attached to the container attachment portion 109, and a function of releasing the lock. The lock engagement piece 203 is a claw portion formed in a front side portion of the housing right wall 200R so as to project to the container attachment portion 109 side and locks the toner container 30. The lock release button 202 is energized toward the front by a lock energizing spring (not shown). When the lock release button 202 is pressed against an energizing force of the lock energizing spring, the lock engagement piece 203 is separated from the toner container 30 to release the lock of the toner container 30.

The toner supply port 25 is an opening portion opened in the top plate of the development housing 200 to have a substantially rectangular shape and communicates with an inside of the development housing 200. When the toner container 30 is attached to the container attachment portion 109, the toner discharge port 30P and the toner supply port 25 are opposed to each other, so that a toner discharged from the toner discharge port 30P flows from the toner supply port 25 into the inside of the development housing 200.

The releasing projection portion 204 is a projection portion provided behind and adjacent to the toner supply port 25 so as to protrude from the top plate of the development housing 200. When the toner container 30 is attached to the container attachment portion 109, the releasing projection portion 204 presses the lock release portion 323 (FIG. 6) of the container shutter 32. In other words, the releasing projection portion 204 allows slide movement of the container shutter 32.

The pair of container shutter fixing portions 205 is provided to protrude from the top plate of the development housing 200 so as to sandwich the releasing projection portion 204 therebetween in the right and left direction. When the toner container 30 is attached to the container attachment portion 109, a part of a container shutter 32 is engaged with the container shutter fixing portions 205. In this manner, the container shutter 32 is fixed and restricted from moving around.

The pair of shutter springs 206 is a pair of spring members arranged on outer sides in the right and left direction of the pair of container shutter fixing portions 205. The shutter springs 206 are arranged to extend in a front-rear direction, and have rear end portions engaged with the top plate of the development housing 200. The shutter springs 206 have front end portions engaged with right and left end portions of the housing shutter 207, respectively.

The housing shutter 207 is supported in the development housing 200 so as to be slidable relative to the toner supply port 25, and blocks or opens the toner supply port 25. The pair of shutter springs 206 energizes the housing shutter 207 in a direction in which the housing shutter 207 blocks the toner supply port 25. When the toner container 30 is removed from the developing device 20, the housing shutter 207 is energized by the pair of shutter springs 206 to block the toner supply port 25. When the toner container 30 is attached to the container attachment portion 109, the housing shutter 207 presses the container main body 31. Therefore, the shutter springs 206 energize the toner container 30 attached to the container attachment portion 109 toward a direction of an arrow DM via the housing shutter 207.

<About Structure of Toner Container>

Figure 8:
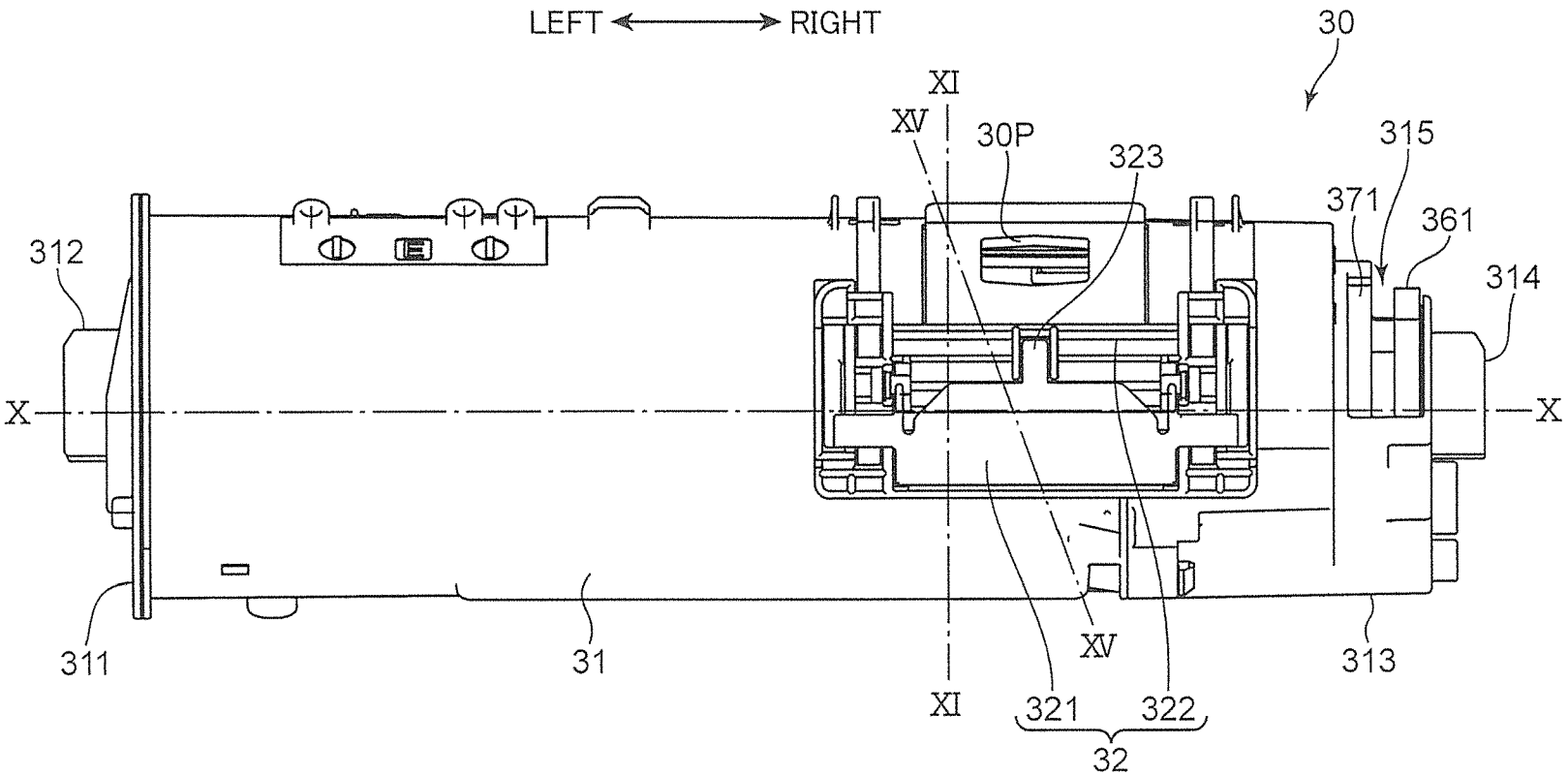
FIG. 8 is a plan view of the toner container.
Figure 9:
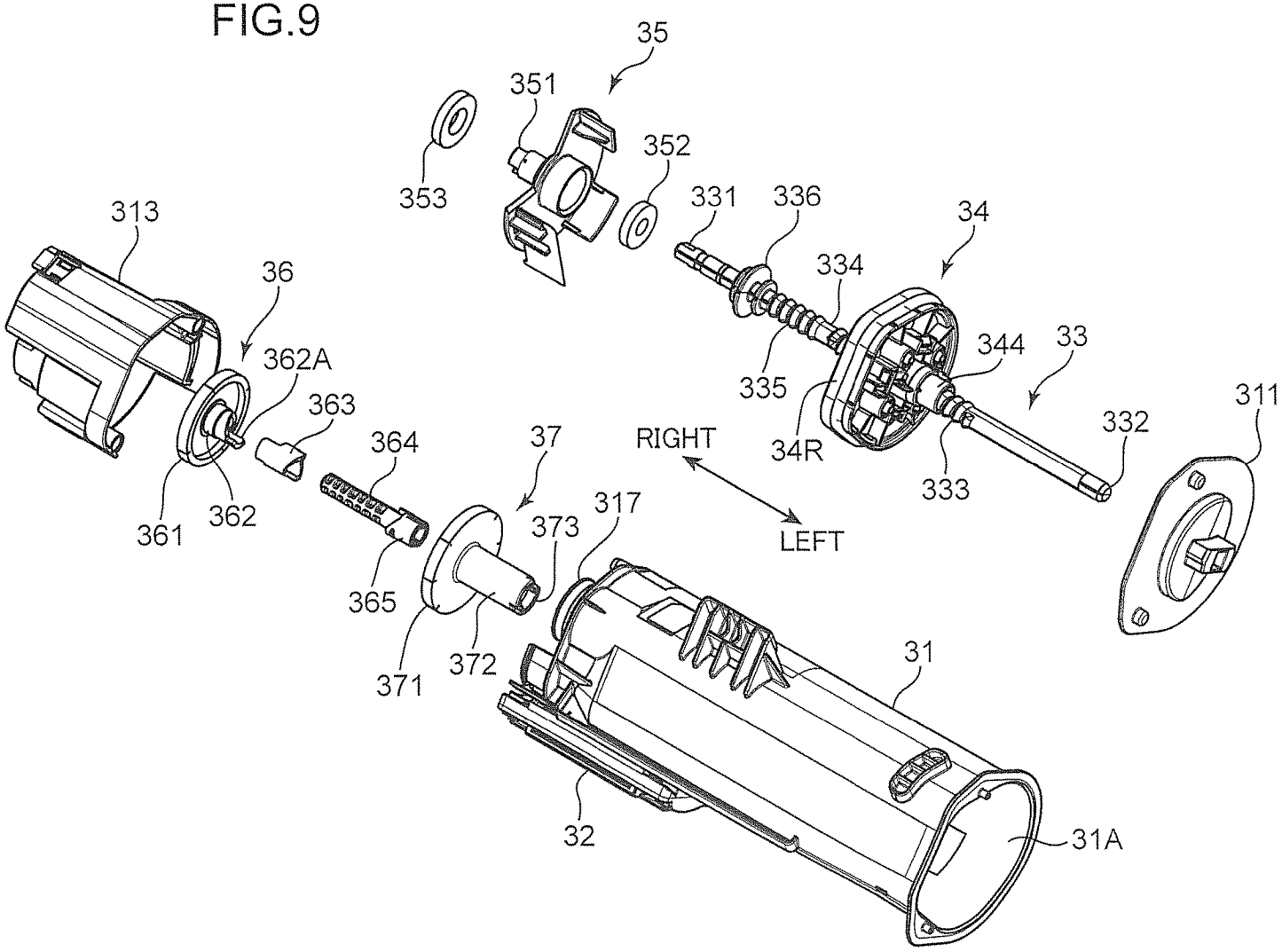
FIG. 9 is an exploded perspective view of the toner container.
Figure 10:
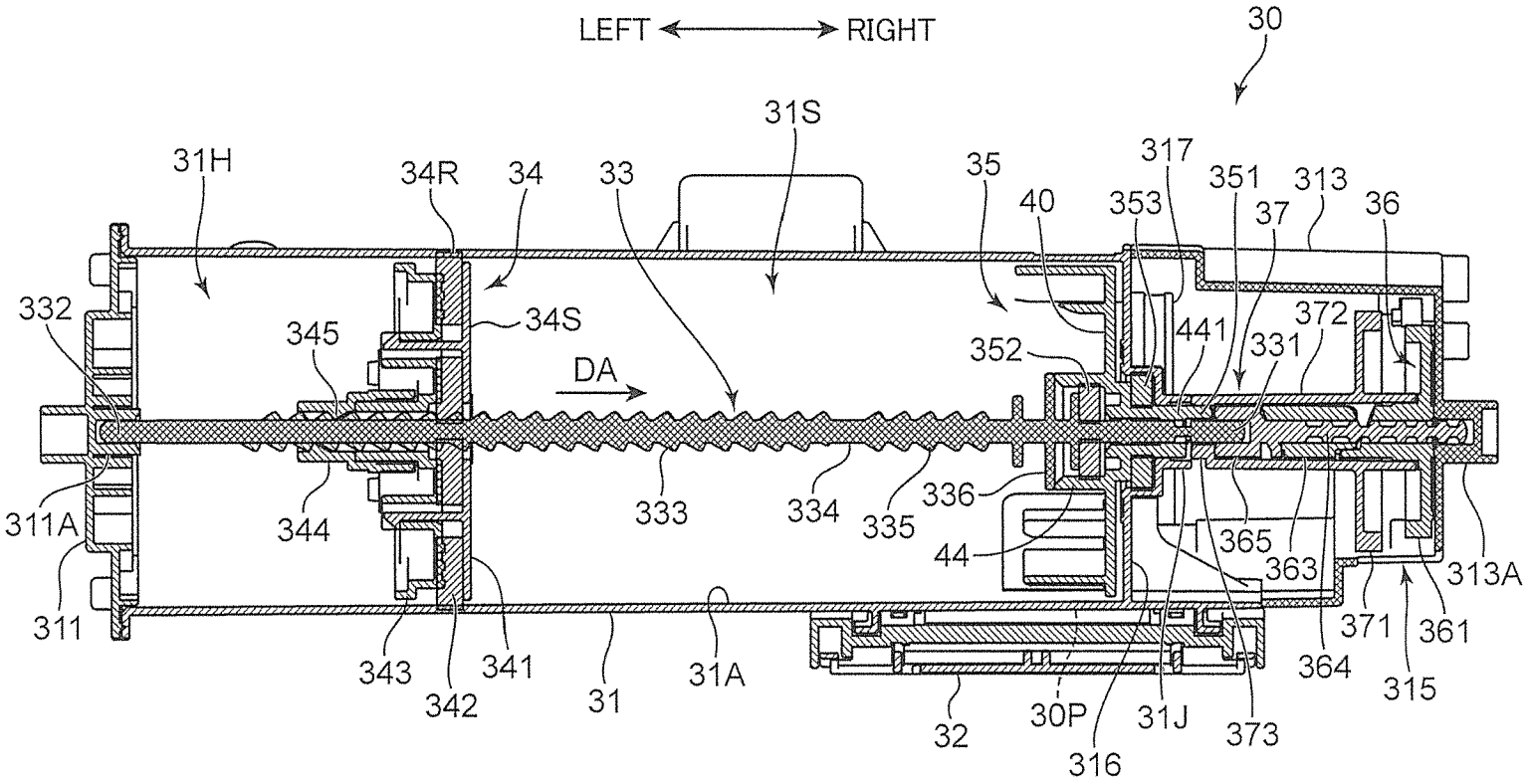
FIG. 10 is a sectional view taken along line X-X in FIG. 8.
Figure 11:
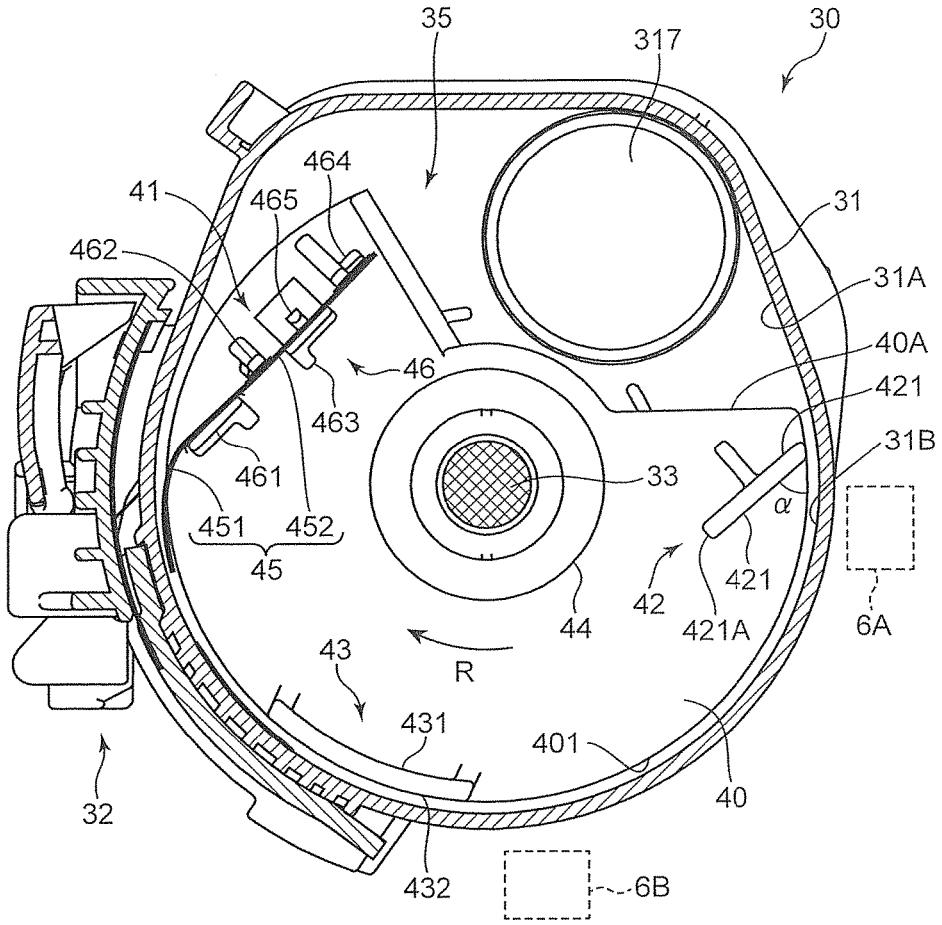
FIG. 11 is a sectional view taken along line XI-XI in FIG. 8.

Next, with reference to FIG. 8 to FIG. 11 in addition to FIG. 6, a structure of the toner container 30 will be described in detail. FIG. 8 is a plan view of the toner container 30, and FIG. 9 is an exploded perspective view of the toner container. FIG. 10 is a sectional view taken along line X-X in FIG. 8, and FIG. 11 is a sectional view taken along line XI-XI in FIG. 8. The toner container 30 is made of a tubular body extending in a direction from left toward right ("a first direction" in the present specification; a direction of an arrow DA in FIG. 10), and a replenishment toner (developer) is stored therein. The toner container 30 includes the shaft portion 33, the movable wall 34, the rotating body 35, the first gear member 36, and the second gear member 37 in addition to the above-described container main body 31 and container shutter 32.

The container main body 31 includes an inner peripheral surface 31A (FIG. 10) which defines an internal space 31H tubularly extending along the first direction (which is also a longitudinal direction of the toner container 30), and a toner discharge port 30P (FIG. 8) opened in a wall surface of the container main body 31 so as to communicate with the internal space 31H for discharging a toner. The above-described lid 311 is arranged on a left end side of the container main body 31 and a right wall 316 is arranged on a right end side thereof. Specifically, the internal space 31H is a space closed by the inner peripheral surface 31A, the lid 311, and the right wall 316.

The right wall 316 is a part integral with the container main body 31. A main body bearing portion 31J for pivotally supporting a right end side of the shaft portion 33 is formed in the right wall 316. A pivotal support portion 311A for pivotally supporting a left end side of the shaft portion 33 is provided on an inner surface of the lid 311. After assembling the shaft portion 33, the movable wall 34, and the rotating body 35 into the internal space 31H, the lid 311 is ultrasonically welded so as to block a left opening of the container main body 31. The toner discharge port 30P is opened, at a position close to the right wall 316, to have a rectangular shape with a predetermined length along the first direction and with a predetermined width along an arc shape of a bottom portion of the container main body 31 in the circumferential direction thereof.

The shaft portion 33 is a shaft arranged to extend in the first direction in the internal space 31H and serving as a moving shaft of the movable wall 34 and as a rotary shaft (a rotary shaft along the first direction) of the rotating body 35. The shaft portion 33 includes a first end portion 331, a second end portion 332, a male spiral portion 333, a movable wall stop portion 334, a support ring portion 335, and a flange portion 336.

The first end portion 331 is the right end portion of the shaft portion 33, the right end portion penetrating the main body bearing portion 31J to project to the right side. A pair of D-cut planes is formed on a peripheral surface of the first end portion 331. The second end portion 332 is the left end portion of the shaft portion 33 and is pivotally supported by the pivotal support portion 311A of the lid 311.

The male spiral portion 333 is a spirally formed screw portion extending in the first direction in an outer peripheral surface of the shaft portion 33. The male spiral portion 333 is formed, in the shaft portion 33, from a region adjacent to the lid 311 to a region upstream of the toner discharge port 30P in the first direction. The movable wall stop portion 334, which is arranged continuously with the downstream side of the male spiral portion 333 in the first direction, is a region of only a shaft part in which no projection in a circumferential direction is present in the shaft portion 33. The support ring portion 335 is a region which is arranged adjacent to the right of the movable wall stop portion 334 and in which a plurality of ring-shaped projections having a radial outer diameter substantially the same as that of the male spiral portion 333 is aligned in the first direction. The flange portion 336 is a disk-shaped part arranged between the first end portion 331 and the support ring portion 335.

The movable wall 34 is a wall portion arranged inside (the internal space 31H) the container main body 31 so as to face the first direction. The movable wall 34 includes an outer peripheral surface 34R arranged to be opposed to the inner peripheral surface 31A of the container main body 31, and a conveying surface 34S which defines, together with the inner peripheral surface 31A, the storage space 31S in which a replenishment toner is stored. In other words, in the internal space 31H, a region between an inner face of a right wall 375 and the conveying surface 34S as an inner face of the movable wall 34 is the storage space 31S in which a toner is actually stored. The movable wall 34 includes, near the radial center thereof, a through hole through which the shaft portion 33 penetrates. The movable wall 34 moves in the first direction (the arrow DA) along the shaft portion 33 in the internal space 31H while conveying the toner in the storage space 31S toward the toner discharge port 30P.

With reference to FIG. 10, the movable wall 34 is formed of an assembly formed of three plate-shaped members arranged in the right and left direction, a wall plate 341, a seal member 342, and a wall main body portion 343. The assembly is pressed by a pressing member 344 to move in the first direction. The wall plate 341 is a plate arranged downstream of the movable wall 34 in the first direction and is formed by resin molding. A right side surface of the wall plate 341 is the above-described conveying surface 34S. The conveying surface 34S conveys a toner in the storage space 31S while pressing the toner as the movable wall 34 moves in the first direction.

The seal member 342 is a member arranged at a position sandwiched between the wall plate 341 and the wall main body portion 343 and made of a urethane material having a predetermined thickness in the first direction. An outer periphery of the seal member 342 forms the outer peripheral surface 34R of the above-described movable wall 34. The wall main body portion 343 is a plate arranged on the most upstream side of the movable wall 34 in the first direction and formed by resin molding. When the wall plate 341, the seal member 342, and the wall main body portion 343 are integrally assembled, the outer periphery of the seal member 342 is arranged on the outermost side in the radial direction. As a result, the outer peripheral part of the seal member 342 (the outer peripheral surface 34R of the movable wall 34) is compressively deformed by the inner peripheral surface 31A of the container main body 31. In this manner, the toner in the storage space 31S is prevented from flowing out from between the inner peripheral surface 31A and the outer peripheral surface 34R to the upstream of the movable wall 34 in the first direction.

The pressing member 344 is a tubular member arranged on the upstream side of the movable wall 34 in the first direction and is externally fitted to the shaft portion 33. The pressing member 344 includes, in an inner peripheral surface thereof, a female spiral portion 345 which is meshed with the male spiral portion 333 of the shaft portion 33. The pressing member 344 proceeds in the first direction along with axial rotation of the shaft portion 33. The pressing member 344 is engaged with the wall main body portion 343 of the movable wall 34 and has a function of pressing the movable wall 34 in the first direction to move along the first direction by the proceeding along the shaft portion 33. In other words, when the shaft portion 33 axially rotates, the pressing member 344 and the movable wall 34 move in the first direction.

The rotating body 35 is arranged, in the storage space 31S, above the toner discharge port 30P and adjacent to the right wall 316. The rotating body 35 is supported by the shaft portion 33 so as to be rotatable around the shaft portion 33. The rotating body 35 includes, on a right end side thereof, an engagement portion 351 which receives input of a rotation driving force. The rotating body 35 performs functions of:

(1) cleaning a toner detection surface 31B (detection surface: FIG. 11) as a toner detection region by the toner sensor 60, which region is a part of the inner peripheral surface 31A that divides the storage space 31S of the container main body 31;

(2) stirring a toner in the storage space 31S; and (3) detecting presence of the container main body 31 (the toner container 30) in the housing 101. The rotating body 35 will be described later in detail.

The first gear member 36 transmits a rotation driving force to the shaft portion 33. The first gear member 36 includes a gear portion 361 formed on an outer peripheral surface of a disk-shaped member, and a cylindrical portion 362 provided to protrude leftward from a radial center of the disk-shaped member. An engagement portion 362A is provided at a left end of the cylindrical portion 362 so as to protrude. For transmitting a rotational force only in one direction to the shaft portion 33, a ratchet mechanism including a ratchet gear 363 and a ratchet shaft 364 is assembled into the first gear member 36. A coupling portion 365 having a D plane shape therein is provided in a left end portion of the ratchet shaft 364. The first end portion 331 with the D-cut plane of the shaft portion 33 is fitted in the coupling portion 365. On the other hand, the ratchet shaft 364 has a central part thereof inserted into the ratchet gear 363 and a right end portion thereof inserted into the cylindrical portion 362 of the first gear member 36.

A rotation driving force of the first motor M1 is input to the gear portion 361 via the third transmission gear 2G3 of the developing device 20. The rotation driving force causes the first gear member 36 to rotate in a predetermined rotation direction, so that the shaft portion 33 is rotated around an axis thereof via the above-described ratchet mechanism. The rotation of the shaft portion 33 causes the pressing member 344 to proceed in the first direction, thereby moving the movable wall 34 in the first direction. The predetermined rotation direction is, although it also depends on a spiral direction of the male spiral portion 333, a rotation direction which causes the movable wall 34 to move in the first direction. When a reverse rotation driving force is applied to the gear portion 361, the reverse rotation driving force will not be transmitted to the shaft portion 33 due to the above-described ratchet mechanism (the ratchet gear 363 idly rotates).

The second gear member 37 transmits a rotation driving force to the rotating body 35. The second gear member 37 include a gear portion 371 formed on an outer peripheral surface of a disk-shaped member, and a cylindrical portion 372 provided to protrude leftward from a radial center of the disk-shaped member. A left end of the cylindrical portion 372 is used as a coupling portion 373 having a recessed portion which engages with the engagement portion 351 of the rotating body 35. A rotation driving force of the second motor M2 is input to the gear portion 371 via the first transmission gear 2G1 and the second transmission gear 2G2 of the developing device 20. In the present embodiment, the second gear member 37 is driven to rotate in synchronization with the developing roller 21, and the first and second stirring screws 23 and 24 of the developing device 20. When the second gear member 37 is driven to rotate, a rotation driving force is transmitted to the rotating body 35 via an engagement portion between the coupling portion 373 and the engagement portion 351, so that the rotating body 35 is rotated around the shaft portion 33.

The cover portion 313 is mounted on the right end side of the container main body 31 and includes a pivotal support portion 313A supporting a right end of the ratchet shaft 364.Thus, the pivotal support 313A performs a function similar to the pivotal support portion 311A provided on the lid 311 for supporting the left end of the shaft portion 33. The cover portion 313 also includes an opening portion 315 (FIG. 10) which exposes a part of the first and second gear members 36 and 37 in a circumferential direction. In a state where the toner container 30 is attached to the developing device 20, the gear portion 361 of the first gear member 36 and the third transmission gear 2G3 mesh with each other and the gear portion 371 of the second gear member 37 and the second transmission gear 2G2 mesh with each other in the opening portion 315.

A closing lid 317 is mounted on the right wall 316 of the container main body 31, the closing lid blocking a toner filling hole for filling the storage space 31S with a toner after the filling. At the time of filling the storage space 31S with a toner, the storage space 31S is filled with a toner by a filling nozzle through the toner filling hole without attachment of the cover portion 313. After the filling, the toner filling hole is fitted in the closing lid 317 and is welded, resulting in mounting the cover portion 313 on the right end side of the container main body 31.

As described in the foregoing, in the printer 100 of the present embodiment, the front cover 104 includes the non-contact type toner sensor 60 formed of a magnetic permeability sensor for detecting a toner stored in the toner container 30. FIG. 12 is a sectional view of a part of the printer 100, on which part the toner container 30 and the toner sensor 60 are mounted. The toner sensor 60 is arranged at a position in the vicinity of the center of the toner container 30 in an up-down direction and adjacent to a front side portion thereof. A part of an outer peripheral surface of the toner container 30 with which the toner sensor 60 contacts is the sensor contact surface 30A shown in FIG. 2, and a part of the inner peripheral surface 31A opposed to the sensor contact surface 30A is the toner detection surface 31B.

<About Movement of Movable Wall>

While the left guide portion 312 of the lid 311 and the right guide portion 314 of the cover portion 313 are guided into the pair of the left guide groove 201L and the right guide groove 201R of the developing device 20, the toner container 30 is attached to the container attachment portion 109 by a user (FIG. 6 and FIG. 7). At the time of attachment of the toner container 30 to the container attachment portion 109, the container shutter 32 is moved to open the toner discharge port 30P. As a result, the toner discharge port 30P is arranged above the toner supply port 25 so as to be opposed thereto (FIG. 4 and FIG. 5).

In this manner, when the new toner container 30 is attached to the printer 100, the controller 50 (FIG. 7) drives the first motor M1, thereby driving the shaft portion 33 to rotate via the first gear member 36 meshed with the third transmission gear 2G3. As a result, engagement between the male spiral portion 333 of the shaft portion 33 and the female spiral portion 345 of the pressing member 344 causes the pressing member 344 to move in the first direction (the arrow DA in FIG. 10). Along with the movement of the pressing member 344, the movable wall 34 is pressed to be moved toward the toner discharge port 30P. At this time, the conveying surface 34S pushes a toner to raise a draft level of a toner in the storage space 31S.

When the movable wall 34 moves rightward from an initial position only by a predetermined distance, the draft level of the toner exceeds a height position of the toner detection surface 31B. Then, the toner sensor 60 detects the toner to output a predetermined detection signal (e.g. HIGH signal). Upon receiving the HIGH signal output from the toner sensor 60, the controller 50 causes the shaft portion 33 to stop rotation, thereby stopping movement of the movable wall 34.

As has been described with reference to FIG. 5, the present embodiment employs a volume-replenishment type toner supply method. Therefore, when the accumulation portion 29 (FIG. 5) of a toner on the developing device 20 side blocks the toner supply port 25 from below, the replenishment toner T2 will not fall down from the toner container 30. On the other hand, when a toner is supplied from the developing roller 21 to the photosensitive drum 121 to reduce the toner in the accumulation portion 29, the toner flows into the developing device 20 from the toner discharge port 30P via the toner supply port 25. As a result, in the storage space 31S of the toner container 30, a toner around the toner detection surface 31B disappears, so that the toner sensor 60 outputs a predetermined non-detection signal (e.g. LOW signal). Upon receiving the LOW signal, the controller 50 drives the first motor M1 until the toner sensor 60 outputs a HIGH signal, thereby further moving the movable wall 34 toward the toner discharge port 30P.

The controller 50 drives the second motor M2 to cause the developing roller 21 and the like to rotate according to developing operation in the developing device 20. In conjunction with the rotation operation, the rotating body 35 is rotated around the shaft portion 33 via the second gear member 37 meshed with the second transmission gear 2G2. The rotating body 35 is arranged corresponding to a position where the toner discharge port 30P and the toner detection surface 31B are present in the storage space 31S. The above-described function of the rotating body 35 is exhibited by rotation of the rotating body 35. Specifically, the operation of cleaning the toner detection surface 31B, loosening a toner in the vicinity of the toner discharge port 30P by stirring, and pushing the toner into the toner discharge port 30P is performed. This leads to appropriate execution of toner detection by the toner sensor 60 through the toner detection surface 31B, and also to an increase in flowability of a toner, so that the toner stably falls down from the toner discharge port 30P.

When printing operation is repeated to continue use of the toner in the storage space 31S in the toner container 30, the movable wall 34 reaches a final position before the toner discharge port 30P in due time. Thus, gradual movement of the movable wall 34 in the first direction results in conveying the toner in the storage space 31S to the toner discharge port 30P while pressing the toner to the movable wall 34. Before the movable wall 34 reaches the final position, the storage space 31S is gradually reduced. In other words, the space in which the toner is present inside the toner container 30 is gradually lost. As a result, as compared with a conventional toner container in which a volume of the storage space 31S will not change, the amount of a toner remaining in the container main body 31 at the end of use can be reduced.

In the present embodiment, the movable wall 34 stops at the final position slightly upstream of the toner discharge port 30P in the first direction. In detail, when the female spiral portion 345 of the pressing member 344 reaches the movable wall stop portion 334 along with movement of the movable wall 34, engagement between the male spiral portion 333 and the female spiral portion 345 is released. As a result, transmission of a moving force from the shaft portion 33 to the pressing member 344 is lost to stop the movable wall 34 at the final position. At this time, the movable wall 34 reaches the support ring portion 335 on the shaft portion 33 so as to be stably supported by the support ring portion 335.

<Detailed Structure of Rotating Body>

Figure 13A:
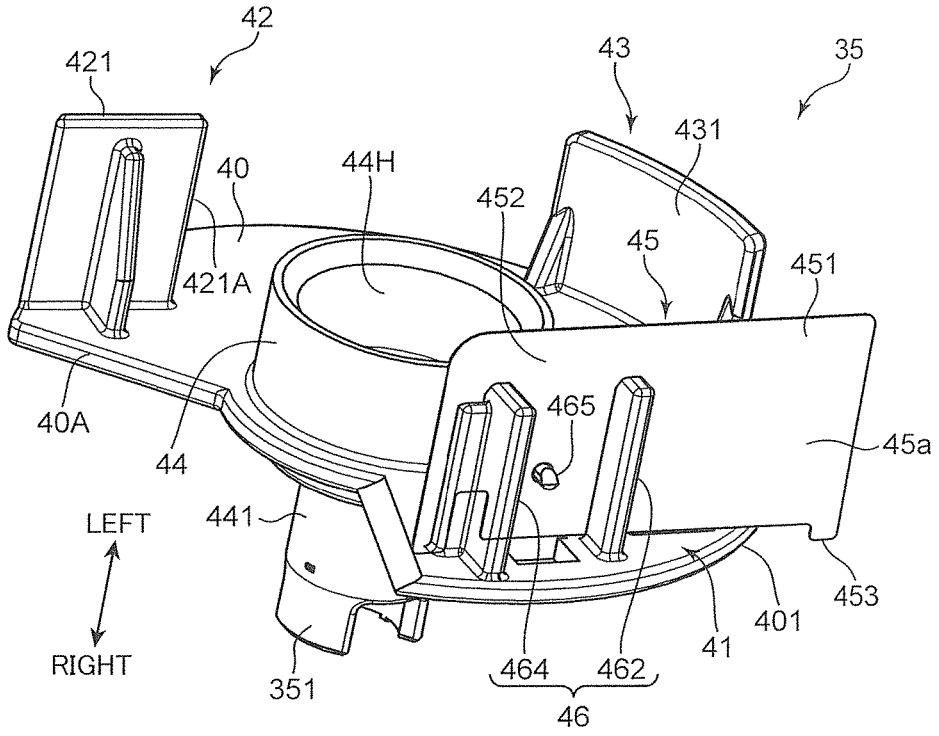
FIG. 13A is a perspective view of a rotating body.
Figure 13B:
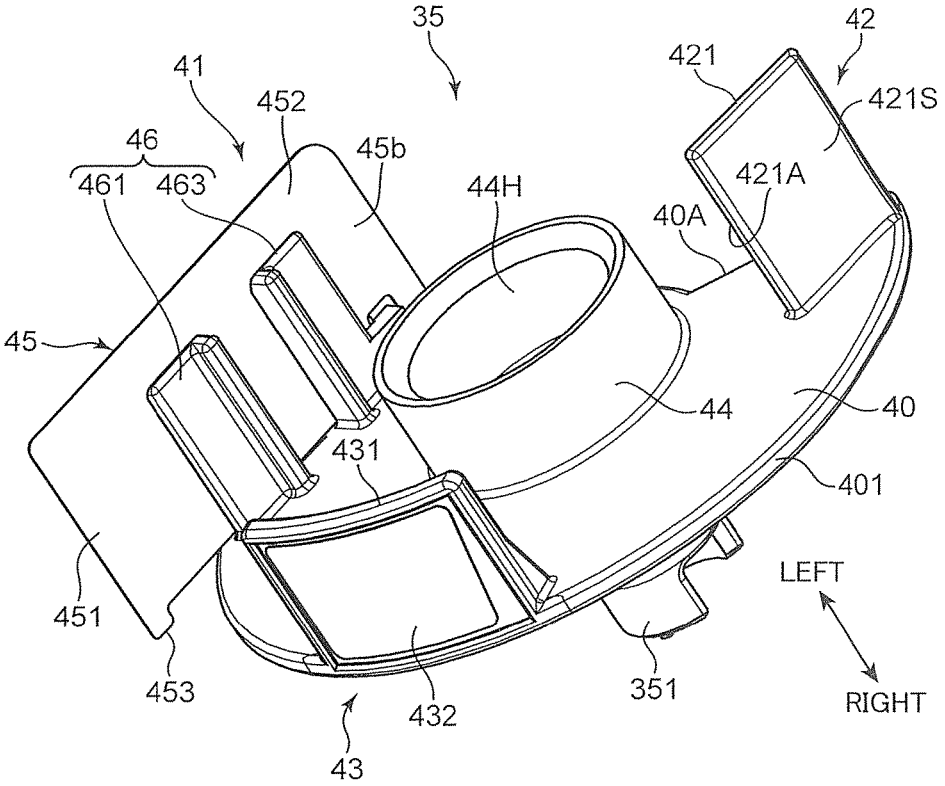
FIG. 13B is a perspective view of the rotating body.
Figure 14:
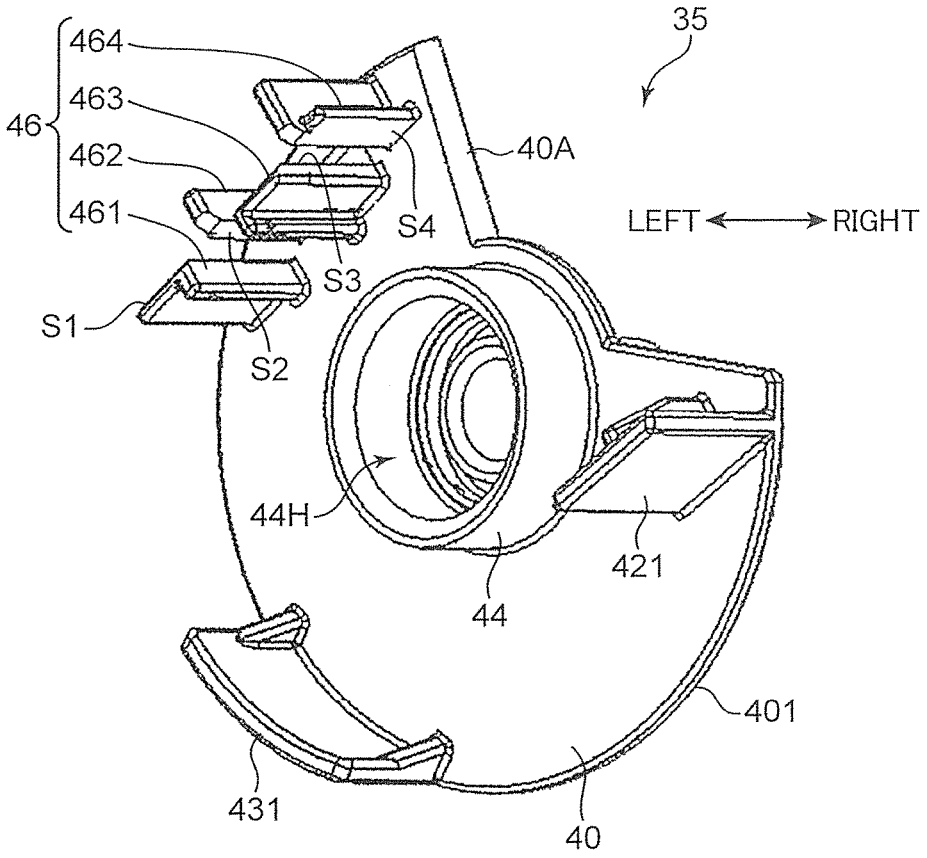
FIG. 14 is a perspective view of the rotating body with a cleaning film removed.
Figure 15:
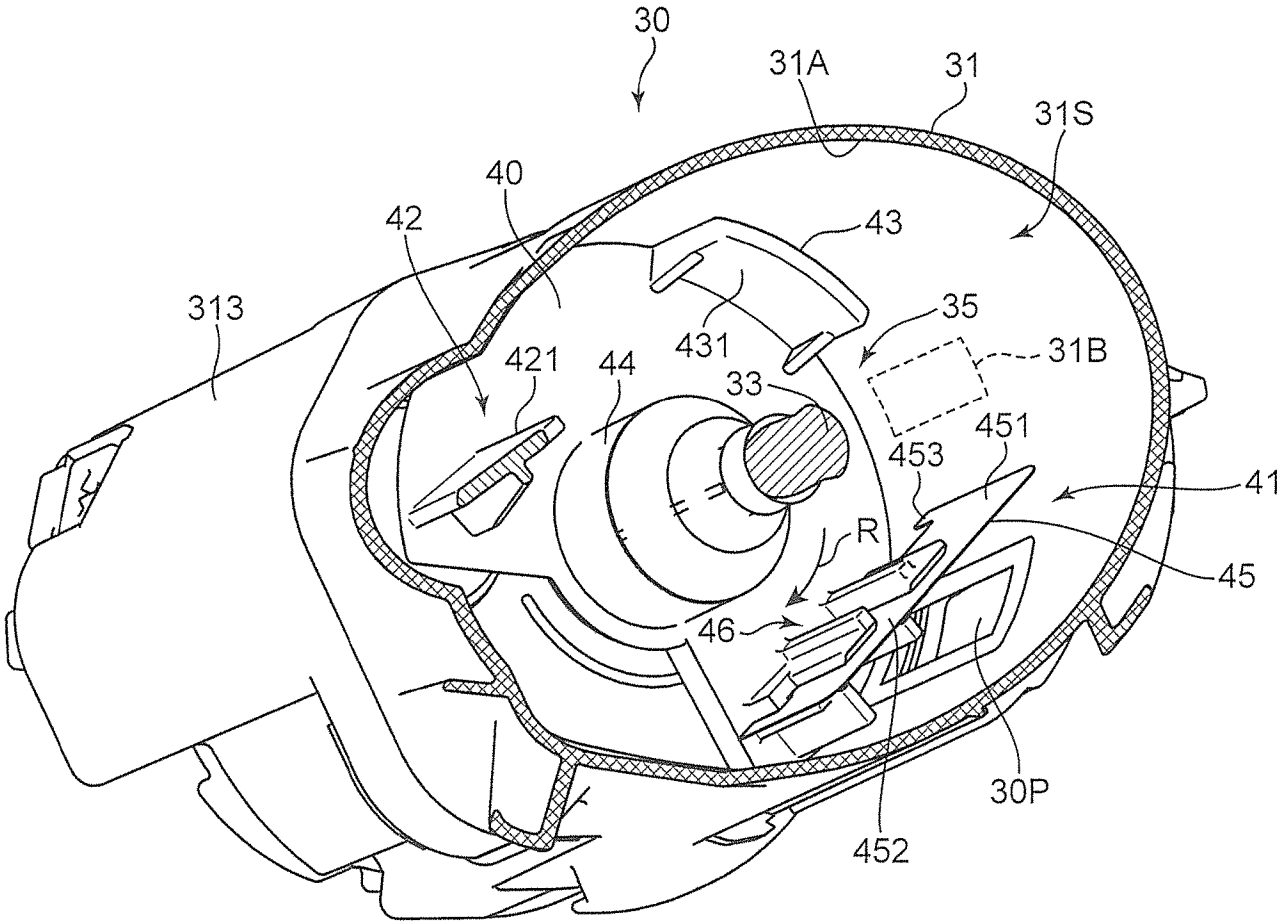
FIG. 15 is a sectional view taken along line XV-XV in FIG. 8.

In the following, with reference to FIG. 13A to FIG. 15 in addition to FIG. 11 and FIG. 12 described above, a detailed structure of the rotating body 35 will be described. FIG. 13A and FIG. 13B are perspective views of the rotating body 35 seen from different angles, FIG. 14 is a perspective view of the rotating body 35 with a cleaning film 45 removed, and FIG. 15 is a sectional view taken along line XV-XV in FIG. 8. The rotating body 35 is made of a resin molded product and includes a flat plate portion 40, a cleaning unit 41 provided to protrude leftward from the flat plate portion 40, a stirring unit 42, and a detection target unit 43.

(Flat Plate Portion)

The flat plate portion 40 is a disk-shaped member. In a state where the rotating body 35 is attached to the shaft portion 33, a left face and a right face of the flat plate portion 40 are planes orthogonal to the shaft portion 33. The flat plate portion 40 includes a substantially fan-shaped notched portion 40A. The notched portion 40A is provided to prevent the rotating body 35 from covering and hiding the toner filling hole (the closing lid 317) when seen from the storage space 31S side as shown in FIG. 11. Specifically, the notched portion 40A is an opening that enables the storage space 31S to be filled with a toner through the toner filling hole. Accordingly, even when the rotating body 35 having the flat plate portion 40 is arranged near the right wall 316 in the storage space 31S, it is possible to fill the storage space 31S with a toner from the outside through the notched portion 40A.

A tubular boss portion 44 is provided on the left face in the vicinity of a radial center of the flat plate portion 40 so as to protrude leftward. A hollow portion 44H is provided inside the tubular boss portion 44, and the tubular boss portion 44 is externally fitted to the shaft portion 33 in such a manner that the vicinity of the first end portion 331 in the shaft portion 33 penetrates the hollow portion 44H. A hollow rear face boss portion 441 is provided on a side opposite to the tubular boss portion 44, i.e., on the right face of the flat plate portion 40, and coaxially with the tubular boss portion 44 so as to protrude rightward. A right end part of the rear face boss portion 441 is the engagement portion 351 which engages with the coupling portion 373 of the second gear member 37 (FIG. 9 and FIG. 10). The shaft portion 33 penetrates the rear face boss portion 441 as well. The flat plate portion 40 extends from the tubular boss portion 44 and the rear face boss portion 441 outwardly in the radial direction. An outer peripheral edge of the flat plate portion 40 is an arc-shaped peripheral edge portion 401. The peripheral edge portion 401 is opposed to the inner peripheral surface 31A of the container main body 31 with a small gap provided therebetween (see FIG. 11).

As shown in FIG. 9 and FIG. 10, a first seal 352 is housed inside the tubular boss portion 44. The first seal 352 is a seal provided in a space between the outer peripheral surface of the shaft portion 33 and an inner peripheral surface of the tubular boss portion 44. The first seal 352 suppresses a toner from leaking from the storage space 31S along a gap between the shaft portion 33 and the rear face boss portion 441. Also, a second seal 353 is provided in a space between an outer peripheral surface of the rear face boss portion 441 and an inner peripheral surface of a boss portion provided in the right wall 316. The second seal 353 suppresses a toner from leaking from the storage space 31S along the outer peripheral surface of the rear face boss portion 441.

(Cleaning Unit)

The cleaning unit 41 is a part which applies a function of cleaning the toner detection surface 31B to the rotating body 35, and includes the cleaning film 45 (the cleaning member) which cleans the toner detection surface 31B, and a holding unit 46 which holds the cleaning film 45. The cleaning film 45 is made of a film-like elastic member having a substantially rectangular shape in a plan view. As the cleaning film 45, for example, a PET film having a thickness which exhibits a required resilience can be used.

The cleaning film 45 includes a front end region 451 which actually makes sliding contact with the toner detection surface 31B, a base end region 452 continuous with the front end region 451, and a projecting piece 453 provided in the front end region 451 to protrude. The holding unit 46 holds the cleaning film 45 in the base end region 452. As shown in FIG. 13A and FIG. 13B, the cleaning film 45 has a linear shape in a state where the rotating body 35 is not housed in the storage space 31S. The front end region 451 extends outwardly from the peripheral edge portion 401 of the flat plate portion 40. The extension length is set to be considerably larger than the gap between the peripheral edge portion 401 and the inner peripheral surface 31A of the container main body 31.

On the other hand, when the rotating body 35 is housed in the storage space 31S, the front end region 451 is curved due to elastic deformation, so that a part of the front end region 451 contacts the inner peripheral surface 31A (the toner detection surface 31B) as shown in FIG. 11. The contact is made by a first surface 45*a* (FIG. 13A), of the cleaning film 45, opposed to the inner peripheral surface 31A. This causes the front end region 451 to make sliding contact with the toner detection surface 31B as the rotating body 35 rotates, thereby cleaning the toner detection surface 31B. A second surface 45*b* (FIG. 13B) on a side opposite to the first surface 45*a* will not contact the inner peripheral surface 31A.

The holding unit 46 includes four projecting pieces arranged so as to sandwich the cleaning film 45 in the base end region 452, i.e., a first supporting piece 461, a second supporting piece 462, a third supporting piece 463, and a fourth supporting piece 464. The first to fourth supporting pieces 461 to 464 are rib-like projections protruding leftward from the flat plate portion 40, the projections having a protrusion height of approximately 80% of a width size of the cleaning film 45. The first to fourth supporting pieces 461 to 464 are aligned at intervals in this order substantially along the peripheral edge portion 401, and aligned in a zigzag manner for forming a slit-shaped space with the cleaning film 45 provided therebetween.

As shown in FIG. 14, the first, second, third, and fourth supporting pieces 461, 462, 463, and 464 have film supporting faces S1, S2, S3, and S4, respectively. The film supporting faces S1 and S3 of the first supporting piece 461 and the third supporting piece 463 are flush with each other, and the film supporting faces S2 and S4 of the second supporting piece 462 and the fourth supporting piece 464 are flush with each other. Then, a slit-shaped space which allows insertion of the cleaning film 45 is ensured between the film supporting faces S1 and S3 and the film supporting faces S2 and S4. The film supporting faces S1 and S3 of the first supporting piece 461 and the third supporting piece 463 support the second surface 45*b* of the cleaning film 45 (FIG. 13B). On the other hand, the film supporting faces S2 and S4 of the second supporting piece 462 and the fourth supporting piece 464 are flush with each other and support the first surface 45*a* of the cleaning film 45 (FIG. 13A).

Of the first to fourth supporting pieces 461 to 464, the cleaning film 45 is supported by the first supporting piece 461 so as to be in contact therewith without being fixed, the first supporting piece being closest to the inner peripheral surface 31A. On the other hand, the cleaning film 45 is fixedly supported by the three supporting pieces, i.e., the second to fourth supporting pieces 462 to 464 spaced more apart from the inner peripheral surface 31A than the first supporting piece 461. In other words, the base end region 452 of the cleaning film 45 is supported by the first supporting piece 461 so as to be slidable, i.e., bendable. On the other hand, a part of the base end region 452 sandwiched by the second to fourth supporting pieces 462 to 464 is held substantially not to have bending deformation.

The projecting piece 453 protruding in the front end region 451 is provided to prevent the cleaning film 45 from fitting in the toner discharge port 30P when the cleaning film 45 passes over the toner discharge port 30P as the rotating body 35 rotates, i.e., to prevent the cleaning film 45 from rejecting a toner at a position of the toner discharge port 30P. The mode of the cleaning film 45 including the projecting piece 453 and a supporting manner of the cleaning film 45 by the holding unit 46 will be described later in more detail.

(Stirring Unit)

The stirring unit 42 is a part which applies a toner stirring function to the rotating body 35, and includes a stirring rib 421 (stirring member) which stirs a toner in the storage space 31S. The stirring rib 421 is a rib attached to the rotating body 35 so as to project leftward from the flat plate portion 40. The stirring rib 421 performs a function of loosening a toner in the storage space 31S as the rotating body 35 rotates. According to the present embodiment, it is possible to loosen a toner by a simple structure of a rib along with rotation of the rotating body 35, thereby stirring a toner in the storage space 31S.

The stirring rib 421 has a pressing surface 421S opposed to the inner peripheral surface 31A. An inclination angle $\alpha$ (FIG. 11) of the pressing surface 421S to a tangent line of the peripheral edge portion 401 of the flat plate portion 40 can be set within a range of approximately 30° to 60°, preferably 45°. The stirring rib 421 has an inner edge 421A at a position closest to the tubular boss portion 44. The inner edge 421A is a part positioned at the frontmost in the stirring rib 421 in a rotation direction R of the rotating body 35 shown in FIG. 11. In a state where a toner in the storage space 31S aggregates, when the rotating body 35 rotates, the inner edge 421A slips into the toner aggregate and the pressing surface 421S presses the toner, thereby loosening the toner aggregate. As the rotating body 35 further rotates, the stirring rib 421 stirs the loosened toner to increase flowability of the toner.

A fixed distance is preferably ensured between the inner edge 421A and an outer peripheral surface of the tubular boss portion 44. In a case where the distance therebetween is too short, when the rotating body 35 rotates, a toner has difficulty in escaping to the downstream of the stirring rib 421 in the rotation direction, so that such a phenomenon might occur in which a toner is contrarily pressed and hardened. Accordingly, it is desirable to ensure a gap between the inner edge 421A and the tubular boss portion 44, the gap being approximately equal to a radial direction width of the pressing surface 421S.

(Detection Target Unit)

The detection target unit 43 is a part which applies, to the rotating body 35, a function of detecting the container main body 31 being present in the housing 101. The detection target unit 43 includes a copper tape 432 (detection target member/detection target piece) as a target of detection by a predetermined sensor (second detection sensor), and an attachment rib 431 to which the copper tape 432 is adhered (attached). As described above, the toner sensor 60 is a magnetic permeability sensor and has sensitivity not only to a toner but also to copper. Accordingly, the toner sensor 60 is used as the predetermined sensor in the present embodiment.

The attachment rib 431 is a rib vertically arranged so as to project leftward from the peripheral edge portion 401 of the flat plate portion 40. The attachment rib 431 is curved in an arc shape and has an outer surface in the radial direction as an adhesion face of the copper tape 432. The copper tape 432 includes a tape main body made of copper or copper alloy, and an adhesive layer provided on one surface of the tape main body. Any other kind of metal tape can be used that enables the toner sensor 60 to have sensitivity. Additionally, not limited to a form of a tape, a mode may be used in which a metal plate or the like is embedded in an attachment rib including a holding unit.

When the rotating body 35 rotates, the detection target unit 43 passes a position of the toner detection surface 31B sooner or later. At this time, the toner sensor 60 generates an output according to detection of the copper tape 432, i.e., generates an output different from that of a toner. Accordingly, setting an appropriate threshold value in advance enables determination of whether the toner sensor 60 detects the copper tape 432 or detects a toner. When the toner sensor 60 generates an output corresponding to detection of the copper tape 432, it is considered that the toner container 30 (the container main body 31) is normally attached to the container attachment portion 109. Thus, a simple structure of adhering the copper tape 432 to the attachment rib 431 enables detection of whether the toner container 30 is present or not.

As shown in a virtual line in FIG. 11, a first detection sensor 6A which detects a toner in the storage space 31S, and a second detection sensor 6B which detects presence/absence of the toner container 30 in the container attachment portion 109 may be separately arranged in the housing 101 or the front cover 104. In this case, the first detection sensor 6A detects a toner in the storage space 31S through the toner detection surface 31B. The second detection sensor 6B detects the detection target member (the copper tape 432) of the detection target unit 43 at a position different from the toner detection surface 31B. However, since use of the toner sensor 60 having sensitivity to both a toner and the copper tape 432 enables one sensor to have the functions of the first and second detection sensors 6A and 6B as in the present embodiment, the number of parts can be reduced to achieve cost-down.

(Layout and Operation)

As is already described, on the left face of the flat plate portion 40, the holding unit 46 (the cleaning unit 41) which holds the base end region 452 of the cleaning film 45, the stirring rib 421 (the stirring unit 42), and the attachment rib 431 (the detection target unit 43) to which the copper tape 432 is adhered, are provided to protrude in a direction (direction along the first direction) orthogonal to the flat plate portion 40. With reference to FIG. 11, the cleaning unit 41, the stirring unit 42, and the detection target unit 43 are arranged near the peripheral edge portion 401 of the flat plate portion 40 at equal intervals approximately in the circumferential direction. In the rotation direction R, the detection target unit 43 is arranged upstream of the cleaning unit 41 and the stirring unit 42 is arranged further upstream of the same.

With reference to FIG. 15, the toner discharge port 30P is arranged at substantially the same position as the toner detection surface 31B in the axial direction (the first direction) of the shaft portion 33, but is arranged at a different position on the inner peripheral surface 31A of the container main body 31 in the circumferential direction. In the rotation direction R, the toner detection surface 31B is positioned upstream of the toner discharge port 30P. The rotating body 35 is mounted on the shaft portion 33 to correspond to the positions of the toner discharge port 30P and the toner detection surface 31B arranged in the circumferential direction. Specifically, the toner discharge port 30P and the toner detection surface 31B are disposed at positions opposed to a rotation locus of the holding unit 46 (the cleaning unit 41), the stirring rib 421 (the stirring unit 42), and the attachment rib 431 (the detection target unit 43). In other words, the toner detection surface 31B is a part of the region of the annular inner peripheral surface 31A opposed to the rotation locus. The toner discharge port 30P has an opening at a position through which the front end region 451 of the cleaning film 45 and the stirring rib 421 pass at the time of rotation of the rotating body 35.

With such layout, when the rotating body 35 rotates around the shaft portion 33 in the rotation direction R, the front end region 451 of the cleaning film 45 makes sliding contact with the toner detection surface 31B to clean the toner detection surface 31B, as well as passing over the toner discharge port 30P while maintaining the sliding contact. The stirring rib 421 passes over the toner discharge port 30P while stirring (pressing) a toner on the rotation locus. Further, the copper tape 432 adhered to the attachment rib 431 circles, at a position close to the inner peripheral surface 31A, along the rotation locus to pass the toner detection surface 31B. Accordingly, it is possible to keep the toner detection surface 31B clean, stir a toner in the storage space 31S to prevent aggregation, and further, detect whether the container main body 31 is attached to the container attachment portion 109 by the toner sensor 60. Accordingly, functionality of the toner container 30 can be improved.

The detection target unit 43 having the copper tape 432 is arranged upstream of the cleaning unit 41 having the cleaning film 45 in the rotation direction R of the rotating body 35. The toner sensor 60 is installed at an external fixed point (the front cover 104) of the container main body 31. Accordingly, after the cleaning film 45 cleans the toner detection surface 31B as the rotating body 35 rotates, the copper tape 432 will pass the toner detection surface 31B. Accordingly, accurate detection of the copper tape 432 by the toner sensor 60 can be ensured.

The cleaning film 45 and the stirring rib 421 also have a function of pressing a toner toward the toner discharge port 30P. Specifically, the cleaning film 45 and the stirring rib 421 pass the position of the toner discharge port 30P at the time of rotation of the rotating body 35. At the time of the passage, the cleaning film 45 and the stirring rib 421, which press a toner toward the toner discharge port 30P, enable operation of actively supplying the toner in the container main body 31 to a replenishment destination (the developing device 20) through the toner discharge port 30P. In other words, by rotating the rotating body 35 as required, a toner replenishment operation is conducted. Since the cleaning film 45 passes the position of the toner discharge port 30P with the front end region 451 in sliding contact with the inner peripheral surface 31A, an excessive toner might be sent out. For preventing the excessive toner replenishment, the front end region 451 is provided with the projecting piece 453. Subsequently, the cleaning film 45 including the projecting piece 453 will be described in detail.

<Configuration Related to Relationship Between Cleaning Film and Toner Discharge Port>

Figure 16A:
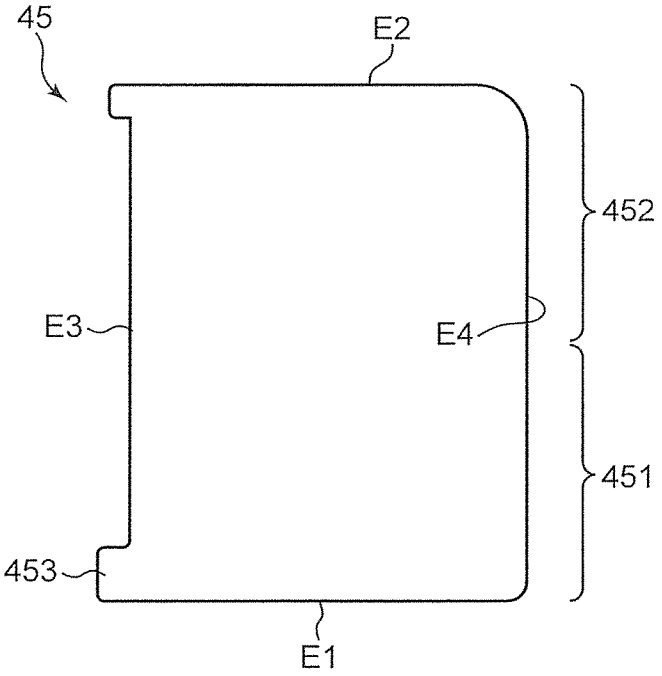
FIG. 16A, FIG. 16B, and FIG. 16C are plan views of the cleaning film.

FIG. 16A is a plan view of the cleaning film 45. As described above, the cleaning film 45 has a rectangular shape and includes the front end region 451 making sliding contact with the inner peripheral surface 31A, and the base end region 452 to be held by the holding unit 46 of the rotating body 35. The rectangular cleaning film 45, when held by the rotating body 35, includes an axial direction front end side portion E1 and an axial direction base end side portion E2 which form sides along the first direction, and a circumferential direction right side portion E3 and a circumferential direction left side portion E4 which form sides along the circumferential direction.

The axial direction front end side portion E1 is a side on the front end region 451 side, and is a side forming a projecting front edge of the cleaning film 45. A fixed region of the front end region 451 with the axial direction front end side portion E1 as a front end makes contact with the inner peripheral surface 31A. The axial direction base end side portion E2 forms a side on the base end region 452 side. The circumferential direction right side portion E3 is a side in contact with or in proximity to the flat plate portion 40 as shown in FIG. 13A and FIG. 13B. The circumferential direction left side portion E4 is a side forming a projecting front edge against the flat plate portion 40.

The projecting piece 453 is a small projecting piece provided at a corner portion where the circumferential direction right side portion E3 and the axial direction front end side portion E1 cross with each other, the projecting piece protruding leftward from the circumferential direction right side portion E3 along the first direction. The cleaning film 45, which is arranged originally for cleaning the toner detection surface 31B, passes not only the toner detection surface 31B but also the position of the toner discharge port 30P at the time of rotation of the rotating body 35. Therefore, the cleaning film 45 is provided with a function of realizing appropriate toner replenishment by pushing a toner into the toner discharge port 30P. However, in a case where the front end region 451 is fitted into the toner discharge port 30P when the cleaning film 45 arrives at the toner discharge port 30P, the front end region 451 presses a toner so as to flip the toner, which might result in discharging an excessive toner from the toner discharge port 30P. The projecting piece 453 is provided to suppress such an excessive toner replenishment.

Figure 17A:
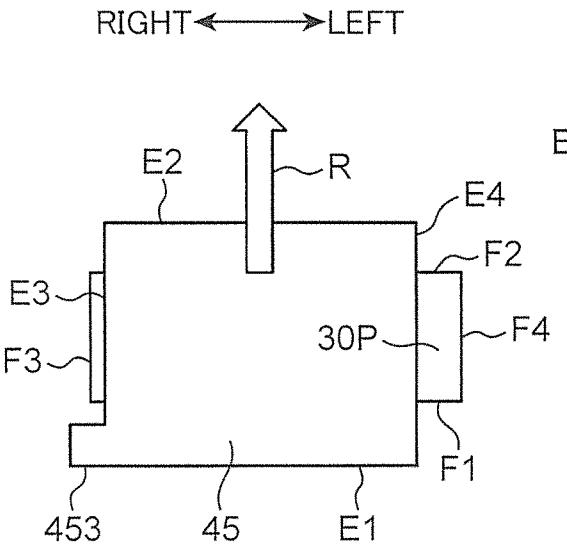
FIG. 17A, FIG. 17B, and FIG. 17C are schematic diagrams showing how the cleaning film passes over a toner discharge port.
Figure 17B:
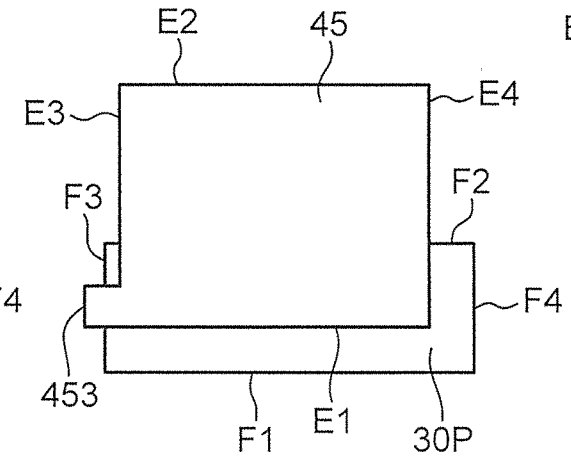
Figure 17C:
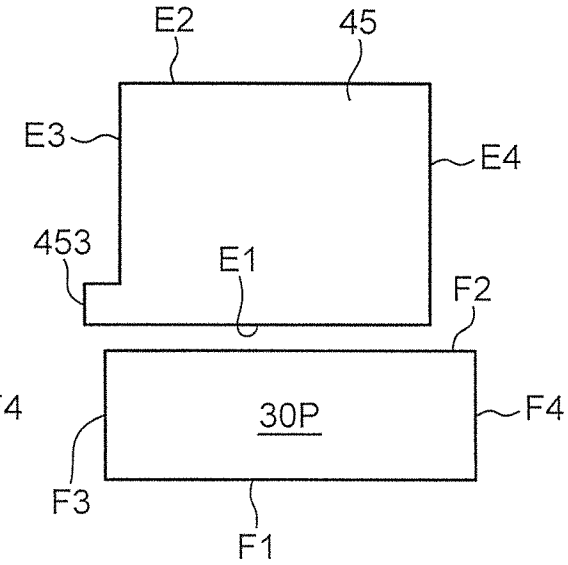

FIG. 17A to FIG. 17C are schematic diagrams showing how the cleaning film 45 passes over the toner discharge port 30P. The toner discharge port 30P is a rectangular opening and has an opening peripheral edge portion formed of an upstream opening edge F1, a downstream opening edge F2, a circumferential direction right opening edge F3, and a circumferential direction left opening edge F4. In the rotation direction R of the rotating body 35, the upstream opening edge F1 defines an upstream side opening edge of the toner discharge port 30P, and the downstream opening edge F2 defines a downstream side opening edge, which are opening edges along the first direction. The circumferential direction right opening edge F3 and the circumferential direction left opening edge F4 define right side and left side opening edges of the toner discharge port 30P.

The cleaning film 45 has a right-left width (an interval between the right side portion E3 and the left side portion E4) set to be smaller than a right-left width (an interval between the right opening edge F3 and the left opening edge F4) of the toner discharge port 30P. Arrangement position of the cleaning film 45 is a position within the width of the toner discharge port 30P, the position being eccentric to the right of the toner discharge port 30P such that an interval between the right side portion E3 and the right opening edge F3 in a plan view is smaller than an interval between the left side portion E4 and the left opening edge F4. On the other hand, the projecting piece 453 is attached to the cleaning film 45 so as to project more rightward than the right opening edge F3. In other words, although the right side portion E3 of the cleaning film 45 is positioned leftward of the right opening edge F3, a right end portion of the projecting piece 453 is positioned rightward of the right opening edge F3.

FIG. 17A schematically shows how a central portion of the cleaning film 45 in a circumferential direction passes the position of the toner discharge port 30P at the time of rotation of the rotating body 35. The projecting piece 453 positioned at the most upstream side of the cleaning film 45 in the rotation direction R is yet to reach the toner discharge port 30P. Although the right side portion E3 and the left side portion E4 of the cleaning film 45 are positioned between the right opening edge F3 and the left opening edge F4 of the toner discharge port 30P, the axial direction front end side portion E1 is yet to reach the toner discharge port 30P. Therefore, the cleaning film 45 will not fall down into the toner discharge port 30P.

FIG. 17B shows a state where the cleaning film 45 proceeds along the rotation direction R, so that the front end side portion E1 passes the upstream opening edge F1 of the toner discharge port 30P. At the time of this passage, the projecting piece 453 enters a state of interfering with the right opening edge F3 (being caught). In other words, the cleaning film 45 enters a state of being cantilevered, at the projecting piece 453, by the inner peripheral surface 31A in the vicinity of the right opening edge F3. Accordingly, when the cleaning film 45 passes the toner discharge port 30P, the front end region 451 will not fit into the toner discharge port 30P. The above interference may be created by causing the right side portion E3 of the cleaning film 45 to pass a position leftward of the right opening edge F3 of the toner discharge port 30P without forming the projecting piece 453.

FIG. 17C shows a state where the cleaning film 45 further proceeds, so that the front end side portion E1 passes the downstream opening edge F2 of the toner discharge port 30P. In this state, a fixed region of the front end side portion E1 of the cleaning film 45 stably makes sliding contact with the inner peripheral surface 31A.

Thus, when the cleaning film 45 passes the toner discharge port 30P, behavior of the cleaning film 45 will not change greatly because of presence of the projecting piece 453. Therefore, such operation can be restricted in which the cleaning film 45 presses a toner to flip the toner and cause excessive toner discharge from the toner discharge port 30P. Accordingly, excessive toner replenishment to the developing device 20 can be prevented.

Figure 18:
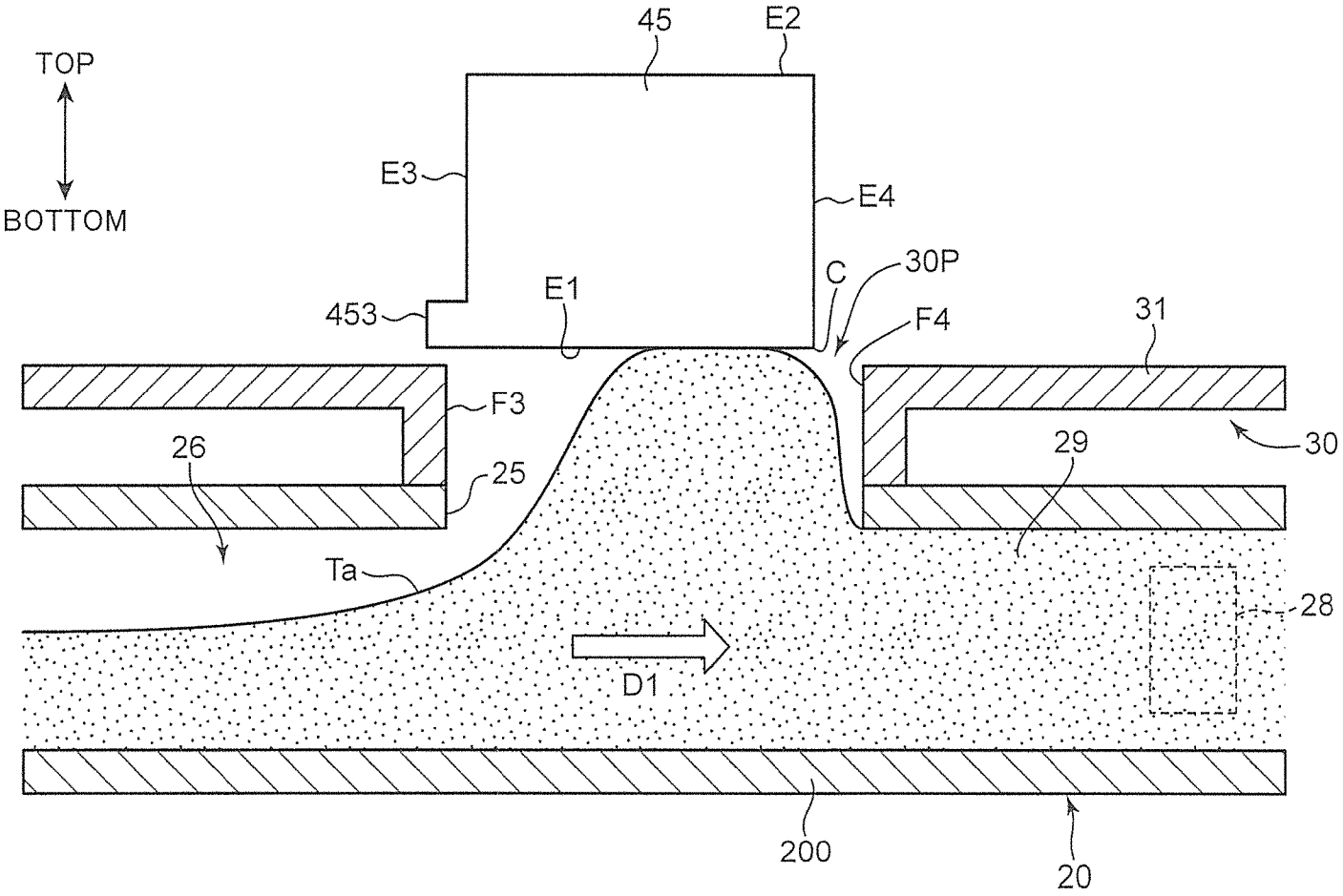
FIG. 18 is a sectional view schematically showing a toner accumulation condition in the vicinity of the toner discharge port and a toner pressing condition by the cleaning film.

Description will be further made of significance of making the projecting piece 453 interfere with the right opening edge F3 of the toner discharge port 30P in the present embodiment. FIG. 18 is a sectional view of a joint portion between the toner container 30 and the developing device 20, the sectional view schematically showing a toner accumulation condition in the vicinity of the toner discharge port 30P and a toner pressing condition by the cleaning film 45. The toner supply port 25 of the development housing 200 is directly coupled to a lower part of the toner discharge port 30P of the container main body 31 to allow inflow of a toner to be discharged from the toner discharge port 30P.

As described above based on FIG. 5, the first stirring screw 23 includes the conveying ability reducing portion 28. Therefore, the accumulation portion 29 of a toner is generated upstream of the conveying ability reducing portion 28 in the toner conveying direction (the arrow D1) in the developer conveyance passage 26 in the development housing 200. The accumulation portion 29 produces a toner draft line Ta which blocks the toner discharge port 30P. The cleaning film 45 shows behavior of pushing a toner toward the toner discharge port 30P when passing the toner discharge port 30P as described above.

As illustrated in FIG. 18, in a coupling portion between the toner supply port 25 and the toner discharge port 30P, the toner draft line Ta is likely to be biased to the downstream side in the toner conveying direction. Specifically, in the toner discharge port 30P, more toner is likely to accumulate near the left opening edge F4 on the downstream side in the toner conveying direction, the left opening edge F4 being closer to the conveying ability reducing portion 28 than the right opening edge F3 is, and a toner is relatively less likely to accumulate in a vicinity of the right opening edge F3. In other words, in a region in proximity to the right opening edge F3 of the toner discharge port 30P, a cavity is relatively likely to be generated, so that a toner is more likely to flow into the development housing 200.

In the present embodiment, however, the projecting piece 453 interferes with the right opening edge F3 of the toner discharge port 30P. Therefore, toner pressing force by the cleaning film 45 is restricted around the right opening edge F3 into which a toner is likely to flow. Accordingly, excessive inflow of a replenishment toner into the development housing 200 can be prevented. In the vicinity of a corner portion C where the front end side portion E1 and the left side portion E4 of the cleaning film 45 cross with each other, although the cleaning film 45 is cantilevered at the projecting piece 453, the cleaning film 45 falls down into the toner discharge port 30P to some extent, so that a corresponding pressing force is generated. However, since a region to which the vicinity of the corner portion C is opposed is where a toner is relatively likely to accumulate, and in the region, the toner discharge port 30P is blocked, excessive supply of toner hardly occurs.

However, there is a concern that the cleaning film 45 might press (flip) a toner in the vicinity of the right opening edge F3 by vibration generated in the cleaning film 45 due to fall-down of the vicinity of the corner portion C into the toner discharge port 30P. Suitable solution to this problem is to provide cleaning films 45A and 45B with a slit portion as illustrated in FIG. 16B and FIG. 16C.

Figure 16B:
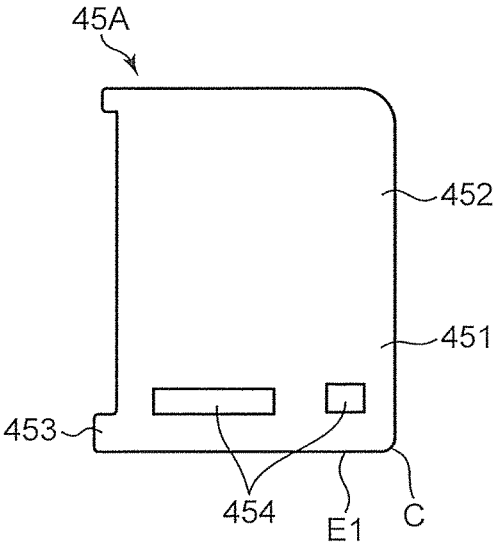
Figure 16C:
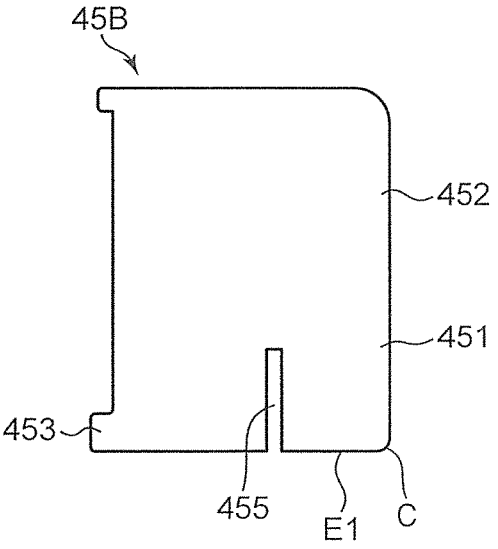

The cleaning film 45A in FIG. 16B has punched slit portions 454 extending in a width direction (the first direction) in proximity to the axial direction front end side portion E1 in the front end region 451. The cleaning film 45B in FIG. 16C has an open slit portion 455 cut in the circumferential direction from the front end side portion E1. Formation of such slit portions 454 and 455 enables adjustment of a butting load against the inner peripheral surface 31A of the front end region 451. Besides, the slit portions 454 and 455 will absorb vibration at the time of fall-down of the above-described vicinity of the corner portion C into the toner discharge port 30P. Accordingly, it is possible to suppress a phenomenon that the front end region 451 flips a toner in the vicinity of the right opening edge F3 due to the vibration.

<Detailed Configuration For Holding Cleaning Film>

Figure 19:
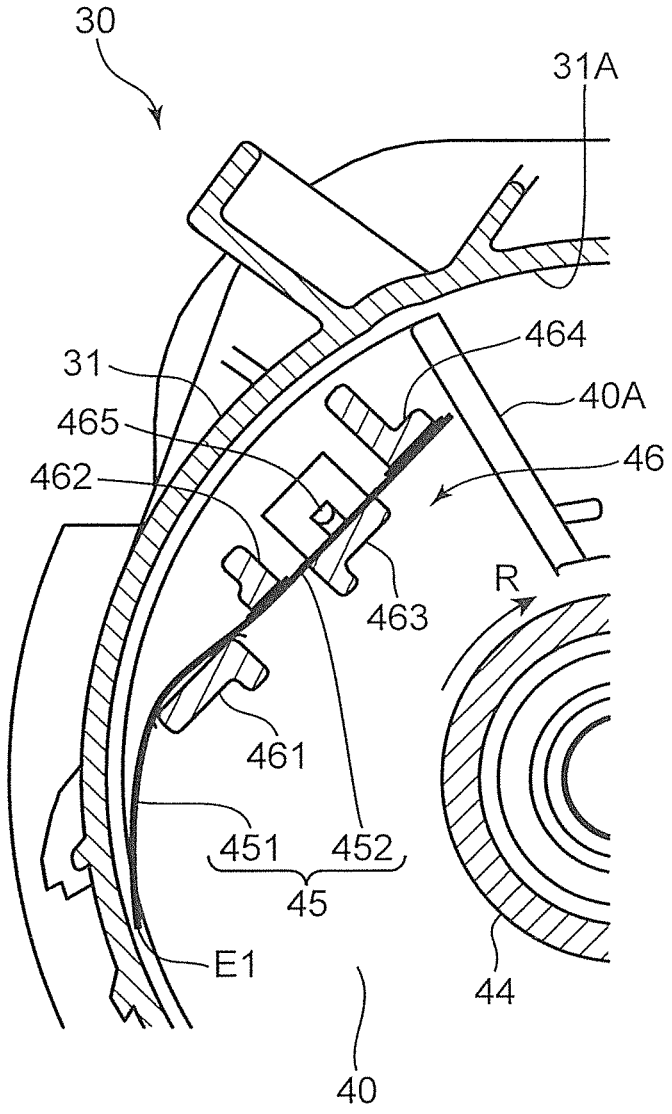
FIG. 19 is a plan view showing a sliding contact condition of the cleaning film.
Figure 20:
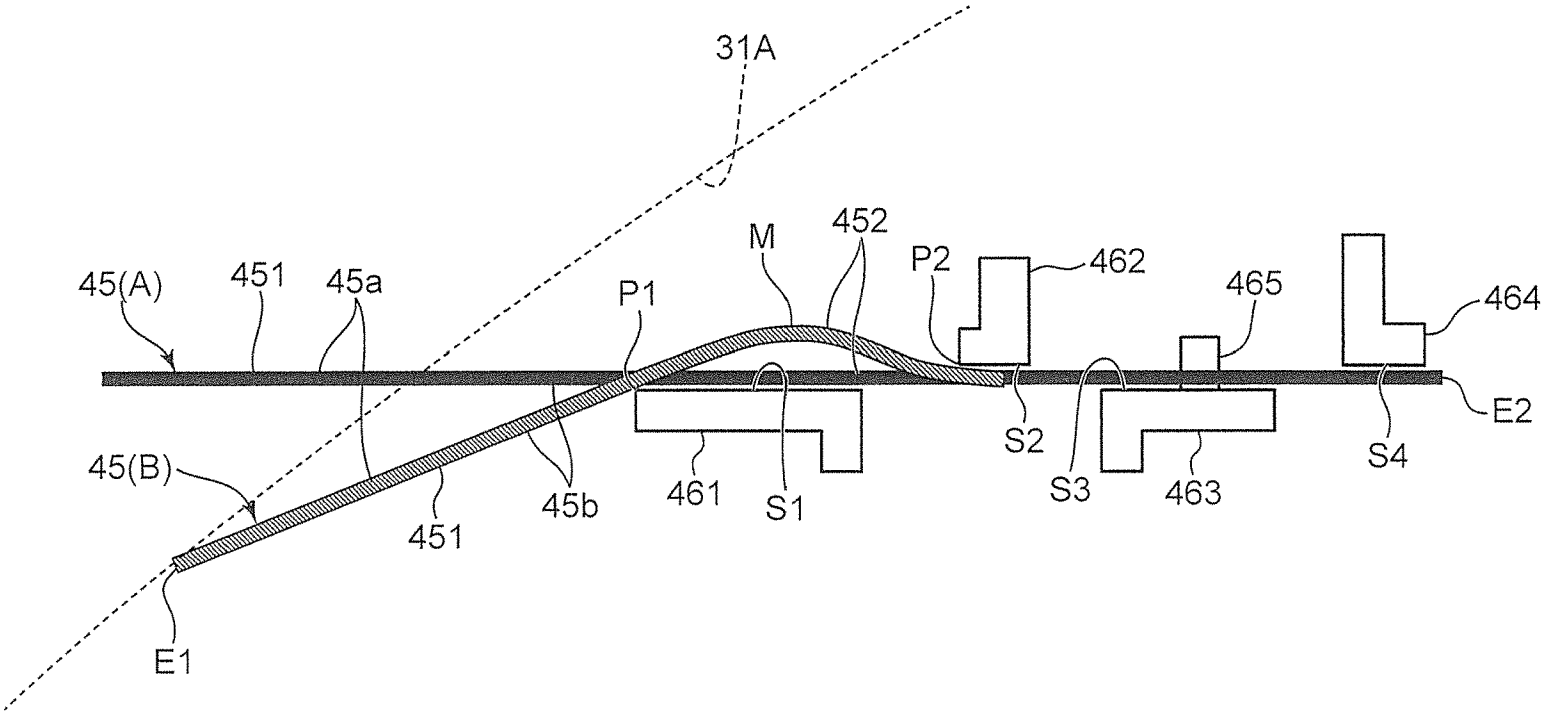
FIG. 20 is a schematic diagram for explaining behavior of the cleaning film.

As has been already described, the cleaning film 45 is held at the rotating body 35 by the holding unit 46 including the first to fourth supporting pieces 461 to 464. A manner of supporting the cleaning film 45 by the holding unit 46 will be further described. FIG. 19 is a plan view showing how the cleaning film 45 makes sliding contact with the inner peripheral surface 31A of the container main body 31, and FIG. 20 is a schematic diagram for explaining behavior of the cleaning film 45.

As shown in FIG. 19, the base end region 452 of the cleaning film 45 contacts the inner peripheral surface 31A and is curved. Since the cleaning film 45 is made of a film-like elastic member and makes sliding contact with the inner peripheral surface 31A (the toner detection surface 31B) along with rotation of the rotating body 35, the cleaning film is under a condition where creep deformation is likely to occur. When the cleaning film 45 has creep deformation, a butting load against the inner peripheral surface 31A becomes short to cause such a trouble as insufficient cleaning of the toner detection surface 31B, insufficient toner pushing force to the toner discharge port 30P, or the like.

In the present embodiment, the cleaning film 45 is supported by the holding unit 46 in a manner of involving none of the above creep deformation. FIG. 20 shows the cleaning film 45 (A) in a first state without contact with the inner peripheral surface 31A and the cleaning film 45 (B) in a second state with contact with the inner peripheral surface 31A. The cleaning film 45 (A) in the first state has the front end region 451 linearly extending from the rotating body 35. On the other hand, the cleaning film 45 (B) in the second state bends due to contact with the inner peripheral surface 31A, and has an upward convex slackening part M at a support position of the first supporting piece 461. Because the cleaning film 45 is supported in a manner of generating such slackening part M, a butting load of the cleaning film 45 against the inner peripheral surface 31A is mitigated. Accordingly, creep deformation of the cleaning film 45 can be effectively prevented.

Description will be made of a configuration realizing a supporting manner in which the slackening part M is generated. Among the first to fourth supporting pieces 461 to 464, the first supporting piece 461 closest to the inner peripheral surface 31A is assumed to be a "first fulcrum portion" and the second to fourth supporting pieces 462 to 464 more apart inwardly from the inner peripheral surface in the radial direction than the first fulcrum portion are assumed to be "the second fulcrum portions". The base end region 452 of the cleaning film 45 is not fixed at the first fulcrum portion and is supported in a contact state, and is fixed at the second fulcrum portion.

The first supporting piece 461 as the first fulcrum portion supports the cleaning film 45 in a contact state without fixing the cleaning film. In detail, the film supporting face Si of the first supporting piece 461 is opposed to the second surface 45*b* of the cleaning film 45, and the cleaning film 45 (A) in the first state is supported with the film supporting face S1 in surface-contact with the second surface 45*b*. In this state, the second surface 45*b* is simply mounted on the film supporting face S1, and both are allowed to come into contact or out of contact with each other. On the other hand, the cleaning film 45 (B) in the second state has the axial direction front end side portion E1 butting against the inner peripheral surface 31A, so that a load in a direction opposite to the extension direction acts on the cleaning film 45. Therefore, in a case of the cleaning film 45 (B) in the second state, the second surface 45*b* contacts the first supporting piece 461 at a fulcrum P1 which is a corner portion of the first supporting piece 461 closest to the inner peripheral surface 31A, but the second surface floats up from the film supporting face S1. In other words, the second surface 45*b* slides with respect to the first supporting piece 461. As a result, the slackening part M is formed in the cleaning film 45.

The slackening part M is formed because the cleaning film 45 is fixedly supported by the second fulcrum portion to be substantially immovable. The film supporting faces S2 and S4 of the second and fourth supporting pieces 462 and 464 of the second fulcrum portion are opposed to the first surface 45*a* of the cleaning film 45. On the other hand, the film supporting face S3 of the third supporting piece 463 positioned in the middle of the second and fourth supporting pieces 462 and 464 is opposed to the second surface 45*b* of the cleaning film 45. The base end region 452 is supported by being sandwiched between the second to fourth supporting pieces 462 to 464 (the film supporting faces S2 to S4) arranged in a zigzag manner. A holding pin 465 is provided to protrude from the film supporting face S3, and a through hole is punched in the cleaning film 45 corresponding to this holding pin 465. Positioning of cleaning film 45 is intended by the insertion of the holding pin 465 into the through hole.

Thus, in the second fulcrum portion, the base end region 452 of the cleaning film 45 is supported from both sides of the first surface 45*a* and the second surface 45*b* by the film supporting faces S2 to S4 and has the holding pin 465 engaged therein. Therefore, in both the cleaning film 45 (A) in the first state and the cleaning film 45 (B) in the second state, the base end region 452 is immovable at the second fulcrum portion. Bending of the cleaning film 45 occurs at a position closer to the front side than a fulcrum P2 which is a corner portion near the inner-most peripheral surface 31A of the second supporting piece 462.

In other words, since the base end region 452 is supported unfixed (unconstrained) in a contact state in the first fulcrum portion, and is fixed (constrained) in the second fulcrum portion, the slackening part M can be formed. The slackening part M enables sliding contact of the cleaning film 45 with the toner detection surface 31B or the inner peripheral surface 31A to have play, thereby suppressing sliding contact at a heavy butting load. Accordingly, it is possible to prevent creep deformation of the cleaning film 45, thereby maintaining performance of cleaning the toner detection surface 31B by the cleaning film 45, and performance of pressing a toner to the toner discharge port 30P for a long period of time.

As described in the foregoing, the toner container 30 of the present embodiment includes the movable wall 34 moving in the first direction along the shaft portion 33, and the rotating body 35 rotating around the shaft portion 33. Then, the rotating body 35 is mounted with three functional members, i.e., the cleaning unit 41, the stirring unit 42, and the detection target unit 43. The respective functional members maintain the toner detection surface 31B detected by the toner sensor 60 clean, stir a toner in the storage space 31S to prevent aggregation, and further enables detection by the toner sensor 60 whether the toner container 30 is attached to a predetermined position.

Accordingly, it is possible to accurately find an amount of toner stored in the container main body 31 by the toner sensor 60 and enable appropriate execution of movement control of the movable wall 34. Additionally, since aggregation of a toner is prevented, a toner with high flowability can be supplied to the developing device 20 through the toner discharge port 30P. Further, attachment of the toner container 30 can be detected using the rotating body 35 without arranging a separate container attachment/detachment sensor or the like.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer container comprising:

a container main body including an inner peripheral surface which defines an internal space tubularly extending in a first direction, and a developer discharge port which is opened to communicate with the internal space and through which a developer is discharged;

a movable wall including an outer peripheral surface arranged to be opposed to the inner peripheral surface of the container main body, and a conveying surface which defines, together with the inner peripheral surface of the container main body, a storage space in which the developer is stored, the movable wall moving in the internal space in the first direction while conveying the developer in the storage space toward the developer discharge port;

a detection surface which is a part of the inner peripheral surface in the storage space of the container main body and becomes a detection region of a first detection sensor which detects the developer in the storage space; and a rotating body arranged in the storage space and capable of rotating around a rotary shaft along the first direction, wherein the rotating body is mounted with a cleaning member which cleans the detection surface, a stirring member which stirs a developer in the storage space, and a detection target member to be a detection target of a second detection sensor which detects presence of the container main body.

2. The developer container according to claim 1, wherein the cleaning member is made of a film-like elastic member and includes a front end region which makes sliding contact with the detection surface and a base end region continuous with the front end region, and the rotating body includes a holding unit which holds the base end region.

3. The developer container according to claim 2, wherein the cleaning member is arranged at a position where the cleaning member passes the developer discharge port at the time of rotation of the rotating body, and has a function of pressing a developer toward the developer discharge port.

4. The developer container according to claim 1, wherein the stirring member is formed of a stirring rib attached to the rotating body and capable of loosening a developer by rotation of the rotating body.

5. The developer container according to claim 4, wherein the stirring rib is arranged at a position where the stirring rib passes the developer discharge port at the time of rotation of the rotating body, and has a function of pressing a developer toward the developer discharge port.

6. The developer container according to claim 1, wherein the detection target member is formed of a detection target piece to which the second detection sensor has sensitivity, and the rotating body includes an attachment rib to which the detection target piece is attached.

7. The developer container according to claim 1, further comprising:

a shaft portion arranged in the internal space to extend in the first direction, wherein the movable wall moves in the first direction along the shaft portion, and the rotating body rotates around the shaft portion with the shaft portion as the rotary shaft.

8. The developer container according to claim 7, wherein the rotating body further includes a tubular boss portion externally fitted to the shaft portion, a flat plate portion outwardly extending in a radial direction from the boss portion, and a peripheral edge portion which is an outer peripheral edge of the flat plate portion and opposed to the inner peripheral surface with a gap provided therebetween, the cleaning member is made of a film-like elastic member and includes a front end region which makes sliding contact with the detection surface and a base end region continuous with the front end region, the stirring member is formed of a stirring rib capable of loosening a developer by rotation of the rotating body, the detection target member is formed of a detection target piece to which the second detection sensor has sensitivity, on the flat plate portion, a holding unit which holds the base end region of the cleaning member, the stirring rib, and an attachment rib to which the detection target piece is attached, are provided to protrude in a direction orthogonal to the flat plate portion, and the developer discharge port is opened at a different position from the detection surface on the inner peripheral surface in a circumferential direction, the position at which the front end region of the cleaning member and the stirring rib pass at the time of the rotation of the rotating body.

9. The developer container according to claim 8, wherein the detection target member is arranged upstream of the cleaning member in a rotation direction of the rotating body.

10. The developer container according to claim 8, wherein the flat plate portion includes a notched portion which enables the storage space to be filled with a developer.

11. An image forming apparatus comprising:

an image carrier having a peripheral surface on which an electrostatic latent image is formed;

a developing device which supplies a developer to the peripheral surface of the image carrier for developing the electrostatic latent image;

the developer container according to claim 1 which replenishes the developer to the developing device;

a first detection sensor which detects a developer in the developer container; and a second detection sensor which detects presence of the container main body.

12. The image forming apparatus according to claim 11, wherein the first detection sensor and second detection sensor are formed of a common.

* * * * *